US011591118B2

(12) United States Patent
Koike et al.

(10) Patent No.: US 11,591,118 B2
(45) Date of Patent: Feb. 28, 2023

(54) LAYERED FOOD PACKAGING SYSTEM, TEMPORARY PLACEMENT APPARATUS, AND CARRIER DEVICE

(71) Applicant: KABUSHIKI KAISHA YASKAWA DENKI, Fukuoka (JP)

(72) Inventors: Haruhiko Koike, Fukuoka (JP); Tomoya Hyodo, Fukuoka (JP); Koji Hara, Fukuoka (JP); Tomohiro Kamishio, Fukuoka (JP); Koichi Kirihara, Fukuoka (JP); Atsuo Ikeda, Fukuoka (JP)

(73) Assignee: KABUSHIKI KAISHA YASKAWA DENKI, Fukuoka (JP)

( * ) Notice: Subject to any disclaimer, the term of this patent is extended or adjusted under 35 U.S.C. 154(b) by 0 days.

(21) Appl. No.: 17/328,110

(22) Filed: May 24, 2021

(65) Prior Publication Data

US 2021/0371136 A1 Dec. 2, 2021

(30) Foreign Application Priority Data

May 29, 2020 (JP) ..... JP2020-094214

(51) Int. Cl.
*B65B 5/04* (2006.01)
*B65B 35/56* (2006.01)
*B65B 35/16* (2006.01)

(52) U.S. Cl.
CPC ..... *B65B 5/045* (2013.01); *B65B 35/16* (2013.01); *B65B 35/56* (2013.01)

(58) Field of Classification Search
CPC ... B65B 35/10; B65B 35/56; B65B 5/04–045; B65B 5/06–067
See application file for complete search history.

(56) References Cited

U.S. PATENT DOCUMENTS

2012/0192526 A1* 8/2012 Spix ..... B65B 25/065 53/396
2012/0217129 A1* 8/2012 Tsutsumi ..... B25J 9/0093 198/339.1

(Continued)

FOREIGN PATENT DOCUMENTS

JP 2002-112716 A 4/2002
JP 2016-119899 A 7/2016

(Continued)

OTHER PUBLICATIONS

Machine translation of WO 2018105690 A1 (Year: 2018).*

*Primary Examiner* — Anna K Kinsaul
*Assistant Examiner* — Himchan Song
(74) *Attorney, Agent, or Firm* — Venjuris, P.C.

(57) ABSTRACT

A layered food packaging system includes: a carrier device configured to convey a sandwich in a horizontal posture in which a layering direction of the sandwich is substantially vertical; a temporary placement table configured to temporarily place the sandwich thereon in a vertical posture in which the layering direction of the sandwich is substantially horizontal; a first robot and a second robot configured to grip the sandwich that is conveyed by the carrier device, lift the sandwich from the carrier device, change the posture of the sandwich from the horizontal posture to the vertical posture, and temporarily place the sandwich on the temporary placement table; and a third robot configured to grip the sandwich that is temporarily placed on the temporary placement table, and insert the sandwich into a bag for packaging the layered food.

4 Claims, 20 Drawing Sheets

(56) References Cited

U.S. PATENT DOCUMENTS

| | | | | |
|---|---|---|---|---|
| 2016/0176654 | A1* | 6/2016 | Gazzola | B65G 47/244<br>414/800 |
| 2018/0201450 | A1* | 7/2018 | Koike | B65G 37/02 |
| 2019/0071195 | A1* | 3/2019 | Hyodo | B65B 35/16 |
| 2019/0337164 | A1* | 11/2019 | Hirata | B25J 15/0616 |
| 2019/0351563 | A1* | 11/2019 | Bando | B65B 5/06 |
| 2020/0039090 | A1* | 2/2020 | Bando | B65B 35/36 |
| 2020/0095001 | A1* | 3/2020 | Menon | B25J 9/1687 |
| 2022/0219851 | A1* | 7/2022 | Powell | B65B 5/045 |

FOREIGN PATENT DOCUMENTS

| | | | | |
|---|---|---|---|---|
| JP | 2019-043648 | A | 3/2019 | |
| WO | WO-2018105690 | A1 * | 6/2018 | B25J 15/0616 |
| WO | 2019208794 | A | 10/2019 | |

* cited by examiner

LAYERED FOOD PACKAGING SYSTEM, TEMPORARY PLACEMENT APPARATUS, AND CARRIER DEVICE

CROSS-REFERENCE TO RELATED APPLICATIONS

This application is based on and claims priority from Japanese Patent Application No. 2020-094214, filed on May 29, 2020, with the Japan Patent Office, the disclosure of which is incorporated herein in its entirety by reference.

TECHNICAL FIELD

The present disclosure relates to a layered food packaging system, and a temporary placement apparatus and a carrier device which are provided in the layered food packaging system

BACKGROUND

Japanese Laid-Open Patent Publication No. 2019-043648 describes a layered food packaging system which includes a carrier device that conveys a layered food, and a piling apparatus that piles up one layered food conveyed by the carrier device on another layered food.

SUMMARY

According to an aspect of the present disclosure, a layered food packaging system includes: a carrier device configured to convey a layered food in a first posture in which a layering direction of the layered food is substantially vertical; a temporary placement apparatus configured to place the layered food thereon in a second posture in which the layering direction is substantially horizontal; a first gripping device configured to grip the layered food that is conveyed by the carrier device, lift the layered food from the carrier device, change the posture of the layered food from the first posture to the second posture, and temporarily place the layered food on the temporary placement apparatus; and a second gripping device configured to grip the layered food that is temporarily placed on the temporary placement apparatus, and insert the layered food into a bag for packaging the layered food.

According to another aspect of the present disclosure, a temporary placement apparatus provided in a layered food packaging system includes: a spacing reduction mechanism configured to temporarily place thereon a layered food that is conveyed in a first posture in which a layering direction of the layered food is substantially vertical, while changing the first posture to a second posture in which the layering direction of the layered food is substantially horizontal, and reduce a spacing between a plurality of pieces of the layered food that is temporarily placed in the second posture, in the layering direction of the layered food.

According to yet another aspect of the present disclosure, a carrier device provided in a layered food packaging system includes: a first conveyance line configured to convey a layered food that is supplied from a previous process before the layered food packaging system toward a processing position where a processing is performed by a packaging mechanism, and convey the layered food that is not processed by the packaging mechanism toward a subsequent process after the layered food packaging system; and a second conveyance line disposed adjacent to the first conveyance line, and configured to convey the layered food that is packaged by the packaging mechanism.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings which form a part hereof. The illustrative embodiments described in the detailed description, drawings, and claims are not meant to be limiting. Other embodiments may be utilized, and other changes may be made without departing from the spirit or scope of the subject matter presented herein.

Hereinafter, an embodiment will be described with reference to the accompanying drawings. In the embodiment, descriptions will be made on a case where sandwiches are packaged as an example of a layered food.

1. Overall Configuration of Sandwich Packaging System

Figure 1:
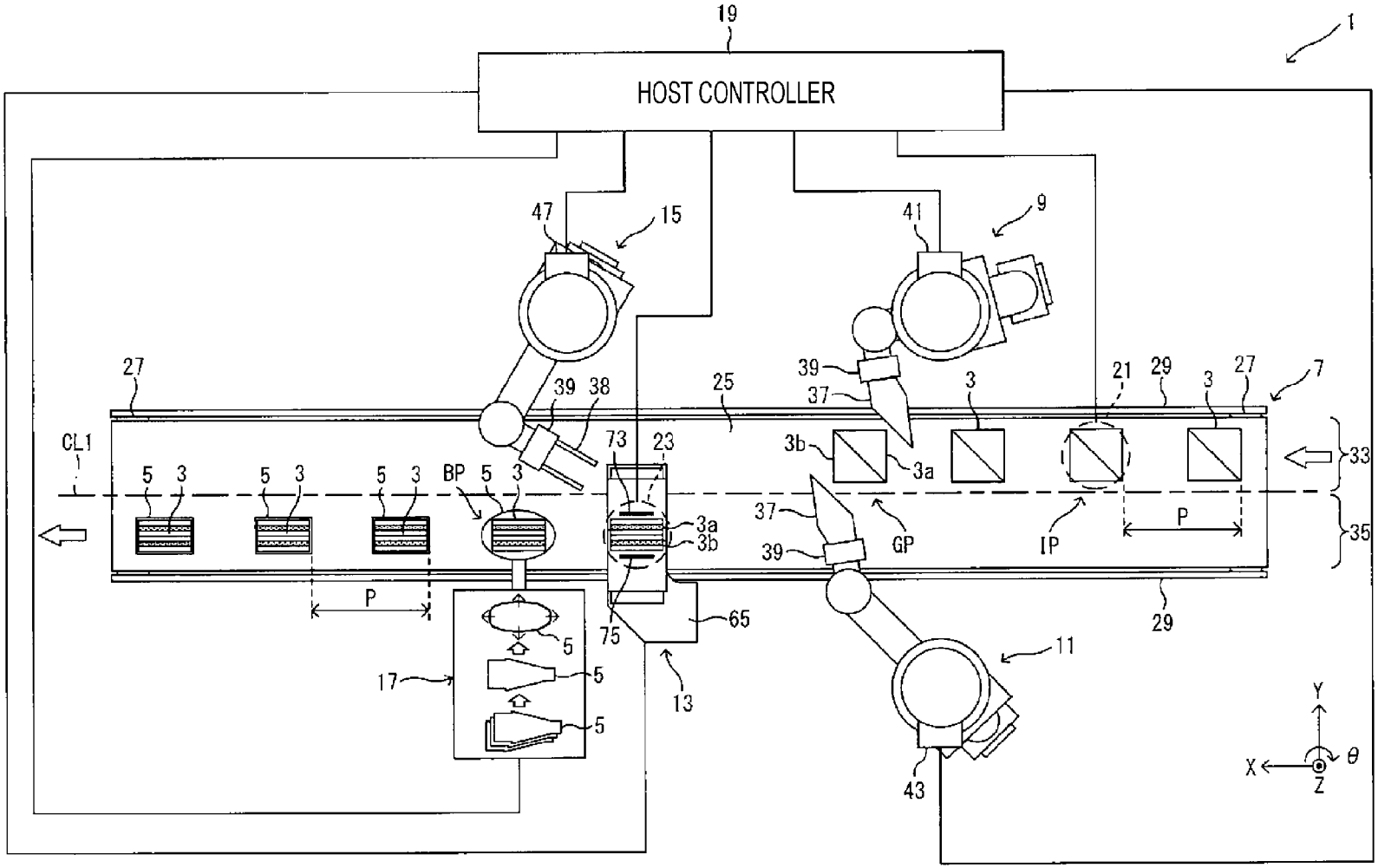
FIG. 1 is a top view illustrating an example of an overall configuration of a sandwich packaging system.
Figure 2:
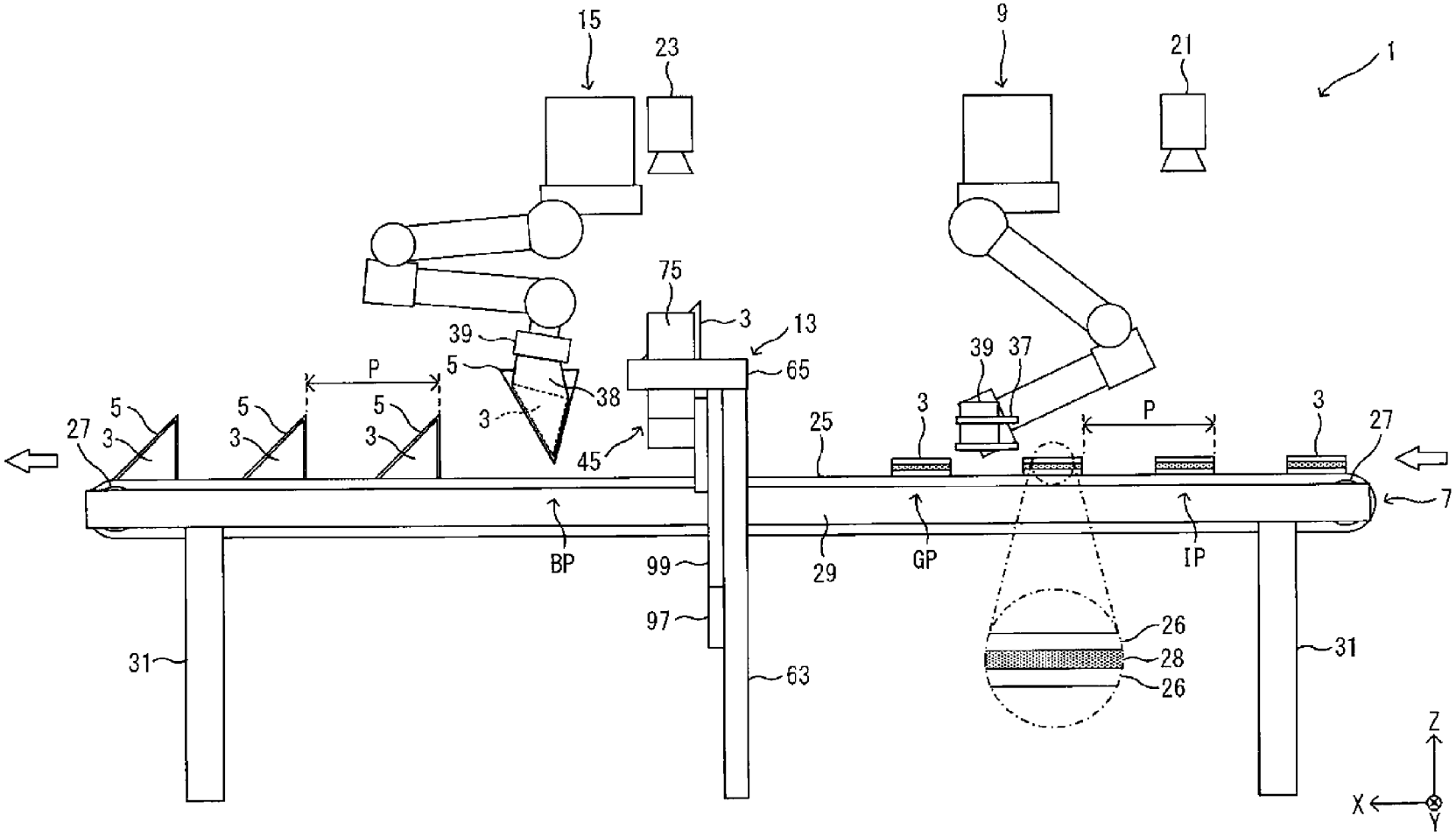
FIG. 2 is a side view illustrating an example of the overall configuration of the sandwich packaging system.
Figure 3:
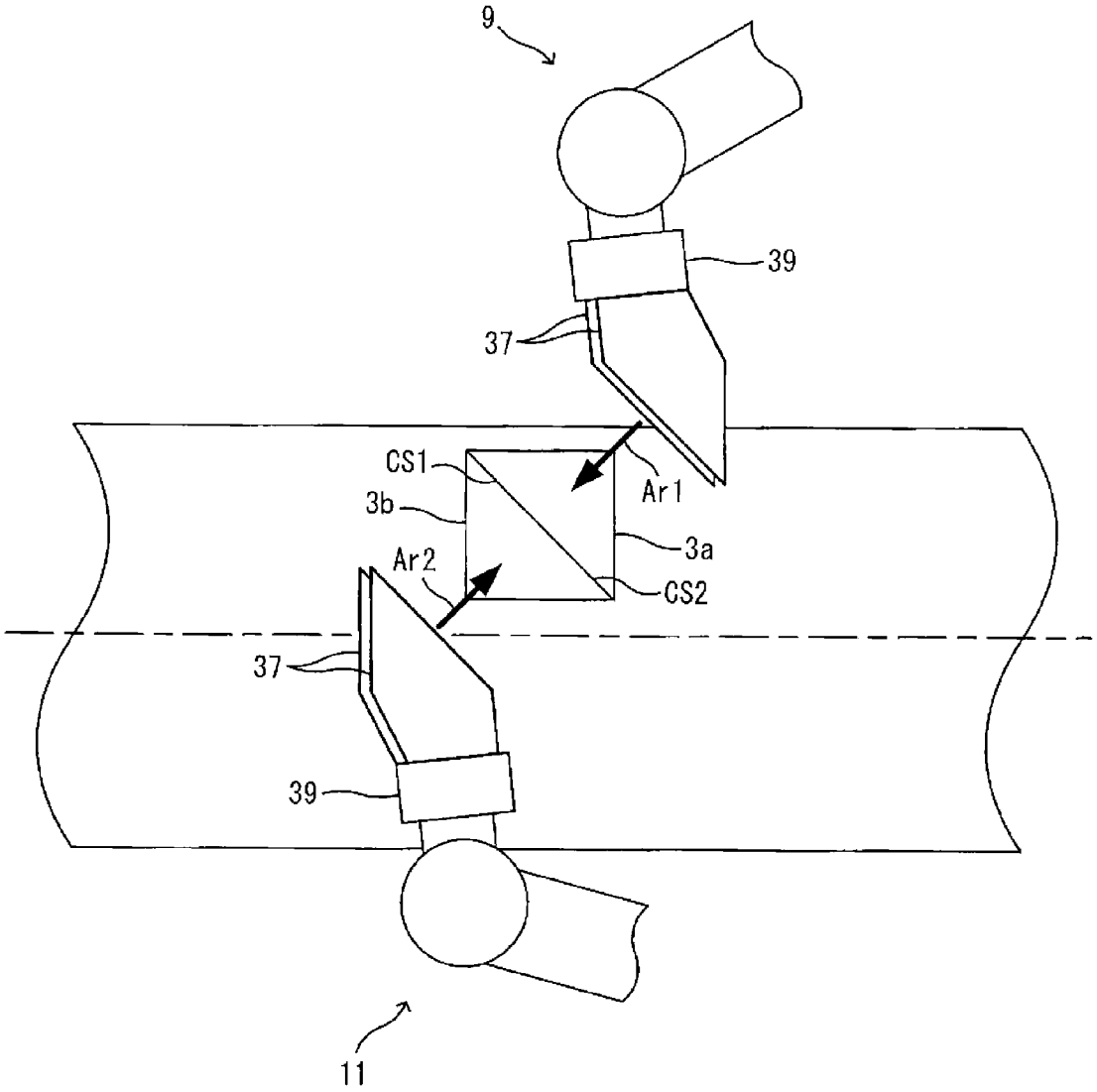
FIG. 3 is a top view illustrating an example of an operation of inserting tong members below sandwiches by first and second robots.

First, an overall configuration of a sandwich packaging system according to an embodiment will be described with reference to FIGS. 1 to 3. FIG. 1 is a top view illustrating an example of the overall configuration of the sandwich packaging system, FIG. 2 is a side view illustrating an example of the overall configuration of the sandwich packaging system, and FIG. 3 is a top view illustrating an example of an operation of inserting tong members below sandwiches by first and second robots.

A sandwich packaging system 1 (an example of a layered food packaging system) is a mechanical system that automatically performs a series of operations including aligning two sandwiches 3 obtained by cutting a sandwich with, for example, a cutter (not illustrated) of a previous process side by side in the layering direction, packaging the sandwiches 3 into a bag 5, and sending out the packaged sandwiches 3 to, for example, a bag closing machine (not illustrated) of a subsequent process. As illustrated in FIGS. 1 and 2, the sandwich packaging system 1 includes a carrier conveyor 7, a first robot 9, a second robot 11, a temporary placement apparatus 13, a third robot 15, and a bag supply device 17, a host controller 19, and detection cameras 21 and 23. For the convenience of descriptions, FIGS. 1 and 2 omit the illustration of, for example, a ceiling frame that supports the robots 9, 11, and 15, the detection cameras 21 and 23 and others above the carrier conveyor 7, and further, FIG. 2 appropriately omits the illustration of, for example, the second robot 11, the bag supply device 17, and the host controller 19.

The carrier conveyor 7 (an example of a carrier device) is a so-called belt conveyor apparatus that drives an annular conveyor belt 25 in a circulating manner with a plurality of rollers 27 arranged inside the carrier conveyor 7. The carrier conveyor 7 sequentially conveys sandwiches 3 in a horizontal posture (an example of a first posture) in which the layering direction is substantially vertical, at an interval of a predetermined pitch P in a first conveyance line 33 to be described later on the conveyor belt 2. Each sandwich 3 is formed by sandwiching ingredients 28 between two loaves of substantially square bread 26 as illustrated in the enlarged view of FIG. 2, and a set of substantially right-angled triangular sandwiches 3*a* and 3*b* formed by diagonally cutting the sandwich 3 are arranged such that the cut surfaces of the sandwiches 3*a* and 3*b* face each other. The carrier conveyor 7 includes a support frame 29 that rotatably supports the plurality of rollers 27, and a leg frame 31. The carrier conveyor 7 may intermittently convey the sandwiches 3 by stopping at a predetermined stop position (e.g., an image capturing position IP where an image capturing is performed by the detection camera 21 or a gripping position GP where a gripping is performed by the first robot 9 and the second robot 11), or may continuously convey sandwiches 3 without stopping. Further, a carrier device other than the belt conveyor such as a roller conveyor may be used.

The conveyor belt 25 of the carrier conveyor 7 is formed to have a wider dimension in the width direction of the conveyor belt 25 than the dimension of each sandwich 3, such that the sandwiches 3 may be conveyed in multiple rows (e.g., two rows in the present embodiment). In the present embodiment, as illustrated in FIG. 1, the carrier conveyor 7 has a structure of two lanes which include a first conveyance line 33 and a second conveyance line 35. The first conveyance line 33 conveys the sandwiches 3 supplied from the previous process before the sandwich packaging system 1 toward the gripping position GP where the gripping is performed by the first robot 9 and the second robot 11, and further, conveys sandwiches 3 that are not gripped by the first robot 9 and the second robot 11 directly toward the subsequent process after the sandwich packaging system 1 through the gripping position GP. In the first conveyance line 33, each sandwich 3 is conveyed in the horizontal posture. The second conveyance line 35 is disposed adjacent to and in parallel with the first conveyance line 33, and conveys sandwiches 3 that are gripped by the first robot 9 and the second robot 11 at the gripping position GP of the first conveyance line 33, temporarily placed on the temporary placement apparatus 13, and inserted/packaged into the bag 5 by the third robot 15, toward the subsequent process after the sandwich packaging system 1. In the second conveyance line 35, each sandwich 3 is conveyed in a vertical posture (an example of a second posture) in which the layering direction is substantially horizontal. The sandwich 3 may be conveyed in the horizontal posture in the second conveyance line 35 as well. The first conveyance line 33 and the second conveyance line 35 are configured to have substantially the same width via a center line CL1 in the width direction of the conveyor belt 25.

The first conveyance line 33 and the second conveyance line 35 may be separate carrier conveyors each having a relatively narrow dimension in the width direction (the Y-axis direction). In this case, the first conveyance line 33 and the second conveyance line 35 may be arranged in different directions, rather than being arranged in parallel with each other. Further, the width of the first conveyance line 33 in which the sandwich 3 is conveyed in the horizontal posture may be set to be different from the second conveyance line 35 in which the sandwich 3 is conveyed in the vertical posture, for example, by setting the width of the first conveyance line 33 to be wider than that of the second conveyance line 35. Further, the carrier conveyor 7 may be configured to have three or more lanes.

Of the sandwiches 3 conveyed by the carrier conveyor 7, the first robot 9 (an example of a first gripping device) grips a sandwich 3*a* placed close to the first robot 9 at the gripping position GP, lifts the sandwich 3*a* from the carrier conveyor 7 to change the horizontal posture into the vertical posture, and temporarily places the sandwich 3*a* on the temporary placement apparatus 13. Similarly, of the sandwiches 3 conveyed by the carrier conveyor 7, the second robot 11 (an example of the first gripping device) grips a sandwich 3*b* placed close to the second robot 11 at the gripping position GP, lifts the sandwich 3*b* from the carrier conveyor 7 to change the horizontal posture into the vertical posture, and temporarily places the sandwich 3*b* on the temporary placement apparatus 13. The first robot 9 and the second robot 11 perform the operations simultaneously in parallel. Further, as illustrated in FIG. 2, the first robot 9 and the second robot 11 (not illustrated in FIG. 2) are installed in the form of being suspended from the ceiling frame (not illustrated) above the carrier conveyor 7. As a result, the space of the bottom surface for installing the robots 9 and 11 thereon may be reduced, so that the sandwich packaging system 1 may be downsized. Further, the first robot 9 and the second robot 11 are configured as similar robots. That is, each of the first robot 9 and the second robot 11 is, for example, a vertical articulated six-axis robot with six joints, and a gripper device 39 is attached as an end effector to the tip of the robot to open/close a pair of tong members 37.

The first robot 9 and the second robot 11 may be configured as different robots. Further, a robot having axes other than six axes (e.g., having five or seven axes) may be used. Further, a robot such as a horizontal articulated robot or a parallel link robot, other than the vertical articulated robot, may be used. Further, instead of a general-purpose robot, a dedicated working machine may be used which is provided with actuators movable, for example, in XYZθ directions and designed exclusively for the gripping work.

The first robot 9 grips the sandwich 3*a* which is a gripping target of the set of sandwiches 3*a* and 3*b* with the tong members 37. Similarly, the second robot 11 grips the sandwich 3*b* which is a gripping target of the set of sandwiches 3*a* and 3*b* with the tong members 37. At this time, as illustrated in FIG. 3, the first robot 9 moves the pair of tong members 37 toward the direction in which the cut surface CS1 of the sandwich 3*a* as the gripping target faces into contact with the cut surface CS2 of the other facing sandwich 3*b* (indicated by an arrow Ar1), and inserts the lower tong member 37 into the lower part of the sandwich 3*a*. Similarly, the second robot 11 moves the pair of tong members 37 toward the direction in which the cut surface CS2 of the sandwich 3*b* as the gripping target faces into contact with the cut surface CS1 of the other facing sandwich 3*a* (indicated by an arrow Ar2), and inserts the lower tong member 37 into the lower part of the sandwich 3*b*. The operations of inserting the tong members 37 by the first robot 9 and the second robot 11 are performed substantially at the same time.

The first robot 9 includes a first robot controller 41, and the second robot 11 includes a second robot controller 43. The robot controllers 41 and 43 control the operations of the robots 9 and 11, respectively, based on commands (e.g., position commands) input from the host controller 19. The robot controllers 41 and 43 are attached to, for example, bases 49 (see, e.g., FIG. 4) of the robots 9 and 11, respectively. Meanwhile, the robot controllers 41 and 43 may be attached to different positions of the robots 9 and 11, or may be disposed separately from the robots 9 and 11. Further, the robot controllers 41 and 43 and the host controller 19 may be configured as an integrated control device, rather than separate bodies. Further, at least one of the robot controllers 41 and 43 and the host controller 19 may be configured by a plurality of control devices.

On the temporary placement apparatus 13, the sandwich 3 is temporarily placed in the vertical posture (an example of the second posture) in which the layering direction is substantially horizontal, by the first robot 9 and the second robot 11. Specifically, the set of substantially right-angled-triangular sandwiches 3*a* and 3*b* formed by diagonally cutting the substantially square sandwich 3 are arranged side by side in the width direction in the same vertical posture in which the cut surfaces CS1 and CS2 face upwardly downstream in the conveyance direction (leftward in FIGS. 1 and 2). At this time, since the two robots 9 and 11 grip and temporarily place the sandwiches 3*a* and 3*b* substantially at the same time, the sandwiches 3*a* and 3*b* are placed with a predetermined spacing therebetween in the layering direction (the Y-axis direction), in order to avoid the interference between the robots 9 and 11. Thus, the temporary placement apparatus 13 includes a spacing reduction mechanism 45 that reduces the spacing in the layering direction between the set of sandwiches 3*a* and 3*b* temporarily placed in the vertical posture. The details of the spacing reduction mechanism 45 will be described later.

The third robot 15 (an example of a second gripping device) grips the sandwiches 3*a* and 3*b* that are temporarily placed on the temporary placement apparatus 13 and spacing-reduced by the spacing reduction mechanism 45, using tong members 38, and inserts the sandwiches 3*a* and 3*b* into the bag 5 for packaging the sandwich 3. As illustrated in FIG. 2, the third robot 15 is installed in the form of being suspended from the ceiling frame (not illustrated) above the carrier conveyor 7. As a result, the space of the bottom surface for installing the third robot 15 thereon may be reduced, so that the sandwich packaging system 1 may be downsized. Further, the third robot 15 is configured as a similar robot to the first robot 9 and the second robot 11, except that the dimension of the tong members 38 is larger than that of the tong members 37. That is, the third robot 15 is, for example, a vertical articulated six-axis robot with six joints, and a gripper device 39 is attached as an end effector to the tip of the third robot 15 to open/close the pair of tong members 38.

The third robot 15 may be a different robot from the first robot 9 or the second robot 11. Further, a robot with axes other than six axes (e.g., five or seven axes) may be used. Further, a robot other than the vertical articulated robot, such as a horizontal articulated robot or a parallel link robot, may be used. Further, instead of a general-purpose robot, a dedicated working machine may be used which is provided with actuators movable, for example, in the XYZθ directions and designed exclusively for the gripping work.

The third robot 15 includes a third robot controller 47. The third robot controller 47 controls the operation of the third robot 15 based on a command (e.g., a position command) input from the host controller 19. The third robot controller 47 is attached to, for example, a base 49 (see, e.g., FIG. 4) of the third robot 15. The third robot controller 47 may be attached to a different position of the third robot 15 or may be disposed separately from the third robot 15. Further, the third robot controller 47 and the host controller 19 may be configured as an integrated control device, rather than separate bodies. Further, at least one of the third robot controller 47 and the host controller 19 may be configured by a plurality of control devices.

The bag supply device 17 takes out a plurality of bags 5 stacked in a folded state one by one, opens/shapes each bag 5, and supplies the bag 5 to a packaging position BP with the opening facing upward. As illustrated in FIG. 2, the third robot 15 inserts the sandwich 3, for example, from above into the bag 5 held at the packaging position BP by the bag supply device 17. The sandwich 3 may be inserted from beside the bag 5 by holding the bag 5 with the opening facing the horizontal direction.

The bagged sandwich 3 is placed in the vertical posture in the second conveyance line 35 on the conveyor belt 25. The carrier conveyor 7 sequentially conveys the sandwiches 3*a* and 3*b* packaged into the bag 5 in the vertical posture at the interval of the predetermined pitch P in the second conveyance line 35 toward the subsequent process.

The host controller 19 controls the entire sandwich packaging system 1. For example, the host controller 19 transmits commands (e.g., position commands) to the first robot controller 41, the second robot controller 43, and the third robot controller 47, to control the operations of the first robot 9, the second robot 11, and the third robot 15. Similarly, the host controller 19 transmits commands to a controller (not illustrated) provided in the temporary placement apparatus 13 and a controller (not illustrated) provided in the bag supply device 17, to control the operations of the temporary placement apparatus 13 and the bag supply device 17. The host controller 19 is configured by, for example, a motion controller, a personal computer (PC), or a programmable logic controller (PLC).

The detection camera 21 is installed above the carrier conveyor 7 upstream in the conveyance direction (the right side in each of FIGS. 1 and 2) from the gripping position GP where the gripping is performed by the first robot 9 and the second robot 11. The detection camera 21 captures an image of the conveyed sandwich 3 from above the image capturing position IP. The result of the image capturing by the detection camera 21 is transmitted to the host controller 19, and the positional deviation of each of the sandwiches 3*a* and 3*b* from a reference position in the X-axis direction, the Y-axis direction, and the θ direction is detected through an image analyzing process. The X-axis direction is the conveyance direction, the Z-axis direction is the vertical direction, the Y-axis direction is the width direction perpendicular to the X-axis and the Z-axis, and the θ direction is the rotation direction around the Z-axis. The host controller 19 corrects position commands to be transmitted to the first robot controller 41 and the second robot controller 43 based on the detected positional deviation, to control the gripping operations by the first robot 9 and the second robot 11.

The detection camera 23 (an example of a camera) is installed above the temporary placement apparatus 13, and captures an image of the tips of the sandwiches 3*a* and 3*b* spacing-reduced by the spacing reduction mechanism 45 downstream in the conveyance direction. The result of the image capturing by the detection camera 23 is transmitted to the host controller 19, and it is detected whether the tips of the sandwiches 3*a* and 3*b* are aligned, through an image analyzing process. Based on the result of the detection of the tips, the host controller 19 determines whether to perform the packaging of the sandwiches 3*a* and 3*b*. For example, when the tips of the sandwiches 3*a* and 3*b* are aligned, it is determined to perform the packaging. Meanwhile, for example, when the tips of the sandwiches 3*a* and 3*b* are not aligned, it is determined not to perform the packaging. When the host controller 19 determines to perform the packaging, the third robot 15 grips the spacing-reduced sandwiches 3*a* and 3*b*, and inserts the sandwiches 3*a* and 3*b* into the bag 5. Meanwhile, when the host controller 19 determines not to perform the packaging, the third robot 15 grips the spacing-reduced sandwiches 3*a* and 3*b*, and discards the sandwiches 3*a* and 3*b*, for example, at a predetermined discarding place. Further, the sandwiches 3*a* and 3*b* may be returned to the first conveyance line 33, such that, for example, a manger may manually correct the alignment of the sandwiches 3*a* and 3*b* to perform the packaging, or may discard the sandwiches 3*a* and 3*b*. Further, the presence/absence of, for example, a deformation or damage of the sandwiches 3*a* and 3*b* may be detected based on the result of the image capturing by the detection camera 23.

Here, the configuration of the sandwich packaging system 1 described above is an example, and is not limited to the descriptions above. For example, in a case where a reduction of cycle time (a reduction of a takt time) is not attempted, only one of the first robot 9 and the second robot 11 may convey sandwiches 3 to the temporary placement apparatus 13.

The above-described first robot 9, second robot 11, temporary placement apparatus 13, and third robot 15 correspond to an example of a packaging mechanism, and the gripping position GP corresponds to an example of a position of a process performed by the packaging mechanism.

2. Configuration of First, Second, and Third Robots

Figure 4:
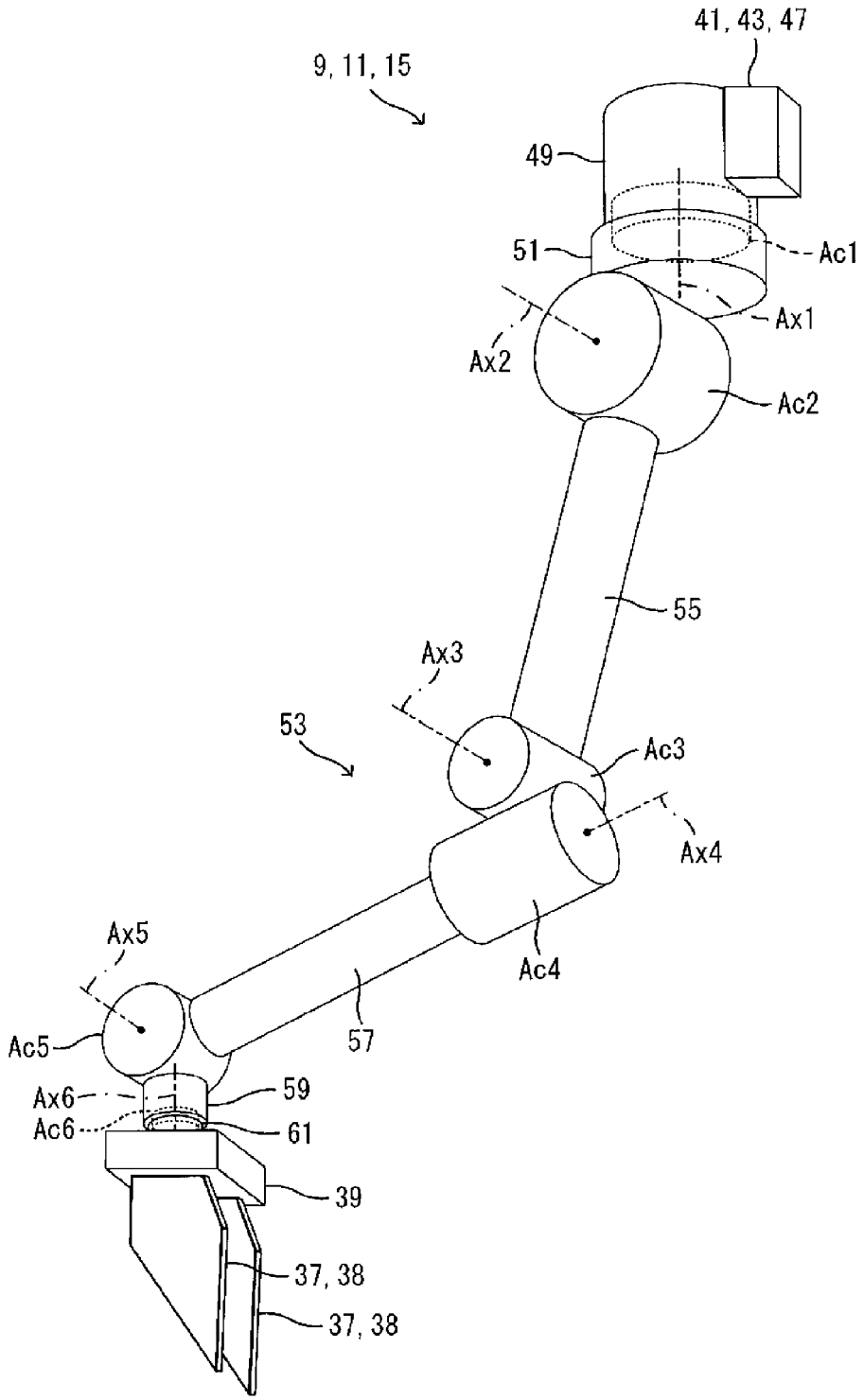
FIG. 4 is a perspective view conceptually illustrating an example of an overall configuration of each of first, second, and third robots.
Figure 5:
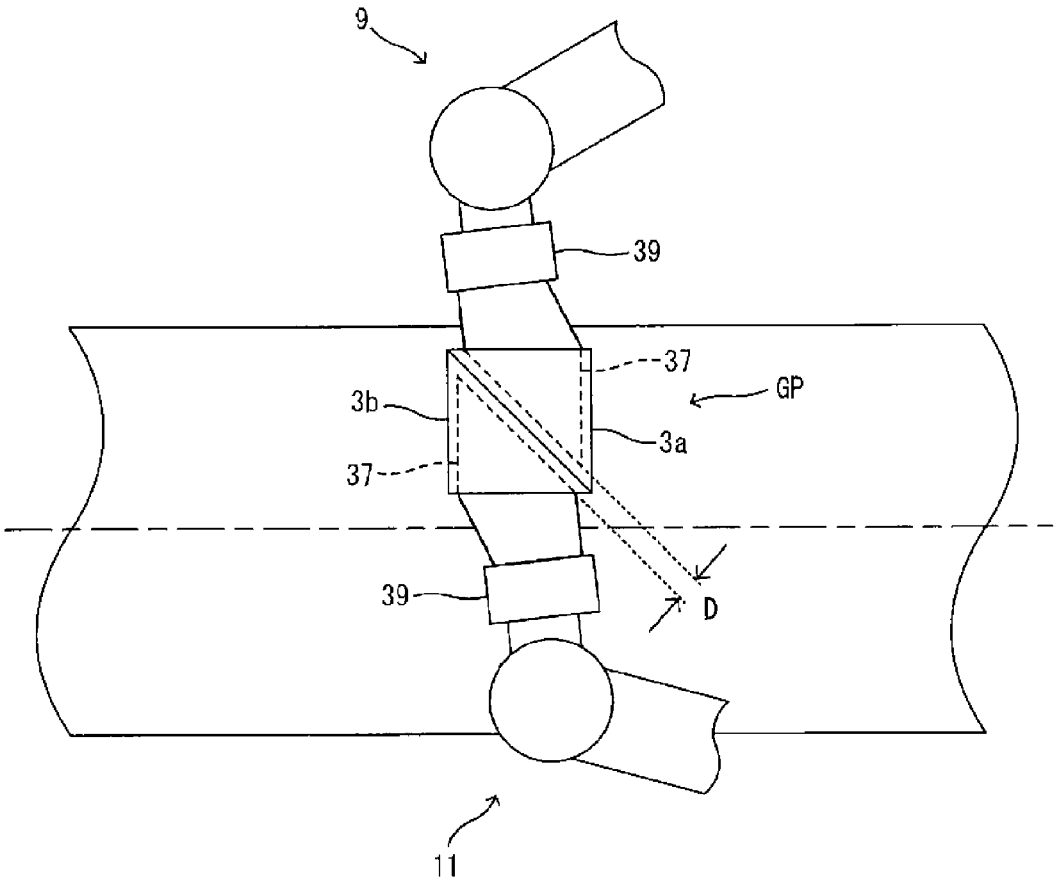
FIG. 5 is a top view illustrating an example of a state where the first and second robots grip sandwiches with tong members at a gripping position.
Figure 6:
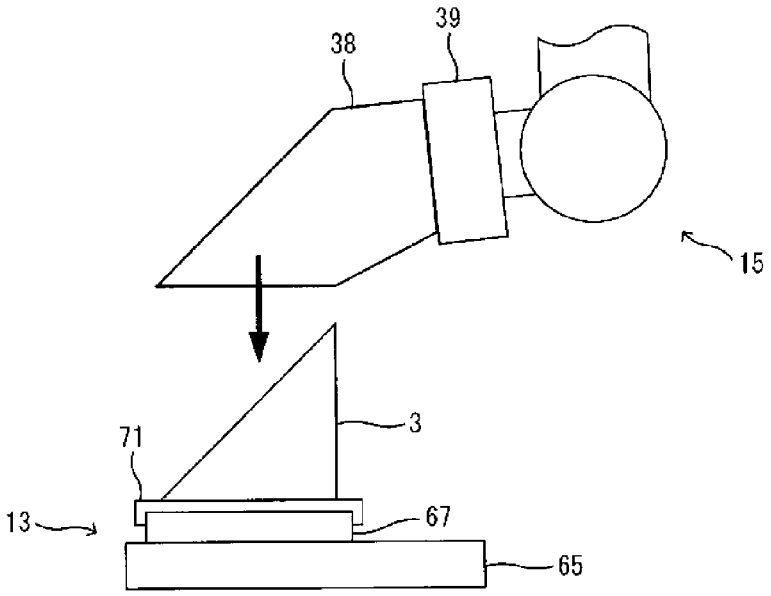
FIG. 6 is a side view illustrating an example of an operation in which the third robot grips sandwiches temporarily placed on a temporary placement apparatus with tong members.
Figure 7:
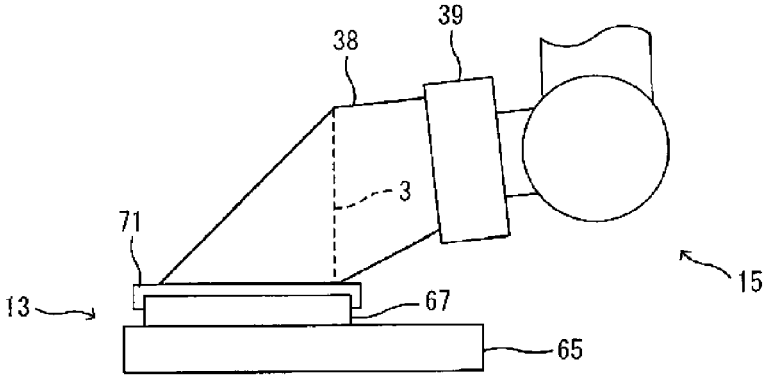
FIG. 7 is a side view illustrating an example of an operation in which the third robot grips sandwiches temporarily placed on the temporary placement apparatus with tong members.

Next, an example of the configuration of the first robot 9, the second robot 11, and the third robot 15 will be described with reference to FIGS. 4 to 7. FIG. 4 is a perspective view conceptually illustrating an example of the overall configuration of the first robot 9, the second robot 11, and the third robot 15. FIG. 5 is a top view illustrating an example of a state where the first robot 9 and the second robot 11 grip the sandwiches 3*a* and 3*b* with the tong members 37 at the gripping position GP. FIGS. 6 and 7 are side views illustrating an example of the operation in which the third robot 15 grips the sandwich 3 temporarily placed on the temporary placement apparatus 13 with the tong members 38. For the convenience of descriptions, FIG. 5 omits the illustration of the tong member 37 of the pair of tong members 37 that is present above the sandwich 3, and FIG. 6 appropriately omits the illustration of, for example, clamping plates 75 of the temporary placement apparatus 13.

As illustrated in FIG. 4, each of the first robot 9, the second robot 11, and the third robot 15 includes the base 49, a pivoting portion 51, and an arm 53. The base 49 is fixed to, for example, the ceiling frame.

The pivoting portion 51 is supported at the lower end of the base 49 to be pivotable around a rotation axis Ax1 substantially parallel with the vertical direction (the Z-axis direction). The pivoting portion 51 is driven to pivot around the rotation axis Ax1 with respect to the lower end of the base 49, by the driving of an actuator Ac1 provided at a joint between the base 49 and the pivoting portion 51.

The arm 53 is supported at, for example, one side of the pivoting portion 51. The arm 53 includes a lower arm 55, an upper arm 57, a wrist 59, and a flange 61.

The lower arm 55 is supported at one side of the pivoting portion 51 to be pivotable around a rotation axis Ax2 substantially perpendicular to the rotation axis Ax1. The lower arm 55 is driven to pivot around the rotation axis Ax2 with respect to one side of the pivoting portion 51, by the driving of an actuator Ac2 provided at a joint between the pivoting portion 51 and the lower arm 55.

The upper arm 57 is supported at the tip of the lower arm 55 to be pivotable around a rotation axis Ax3 substantially parallel with the rotation axis Ax2, and to be rotatable around a rotation axis Ax4 substantially perpendicular to the rotation axis Ax3. The upper arm 57 is driven to pivot around the rotation axis Ax3 with respect to the tip of the lower arm 55, by the driving of an actuator Ac3 provided at a joint between the lower arm 55 and the upper arm 57. Further, the upper arm 57 is driven to rotate around the rotation axis Ax4 with respect to the tip of the lower arm 55, by the driving of an actuator Ac4 provided at a joint between the actuator Ac3 and the upper arm 57.

The wrist 59 is supported at the tip of the upper arm 57 to be pivotable around a rotation axis Ax5 substantially perpendicular to the rotation axis Ax4. The wrist 59 is driven to pivot around the rotation axis Ax5 with respect to the tip of the upper arm 57, by the driving of an actuator Ac5 provided at a joint between the upper arm 57 and the wrist 59.

The flange 61 is supported at the tip of the wrist 59 to be rotatable around a rotation axis Ax6 substantially perpendicular to the rotation axis Ax5. The flange 61 is driven to rotate around the rotation axis Ax6 with respect to the tip of the wrist 59, by the driving of an actuator Ac6 provided at a joint between the wrist 59 and the flange 61.

The gripper device 39 is attached to the tip of the flange 61, and rotates around the rotation axis Ax6 along with the rotation of the flange 61 around the rotation axis Ax6. The gripper device 39 includes the pair of tong members 37 (the tong members 38 for the third robot 15) operable in a direction in which the tong members 37 move close to and away from each other, and grips the sandwich 3. While the tong members 37 and the tong members 38 have different dimensions as described later, FIG. 4 illustrates the tong members as the same members.

Each of the first robot 9, the second robot 11, and the third robot 15 having the configuration described above is the six-axis robot that has the six joints provided with the six actuators Ac1 to Ac6, respectively. The actuators Ac1 to Ac6 that drive the respective joints are each configured by, for example, a motor, an encoder, a speed reducer, or a brake. Further, the actuators Ac1 to Ac6 may not necessarily be disposed on the rotation axes Ax1 to Ax6, and may be disposed at positions away from the rotation axes Ax1 to Ax6.

Meanwhile, in the descriptions above, the "rotation" and the "pivoting" discriminately refer to the rotation around the rotation axis along the longitudinal direction (or the extension direction) of the arm 53, and the rotation around the rotation axis substantially perpendicular to the longitudinal direction (or the extension direction) of the arm 53, respectively.

Next, the difference in dimension between the tong members 37 and the tong members 38 will be described. FIG. 5 illustrates a state where the first robot 9 and the second robot 11 grip the sandwiches 3*a* and 3*b* with the tong members 37 at the gripping position GP. As illustrated in FIG. 5, the tong members 37 (an example of first tong members) are formed such that the tips of the tong members 37 each have a substantially right angled triangular shape which is similar to that of the sandwiches 3*a* and 3*b*. Meanwhile, since the first robot 9 and the second robot 11 do not perform the packaging of the sandwiches 3*a* and 3*b* into the bag 5, the dimension of the tips of the tong members 37 is one size smaller than the dimension of the sandwiches 3*a* and 3*b* (substantially equal to the dimension of the tong members 38 of the third robot 15). As a result, when the tong members 37 of the first robot 9 and the tong members 37 of the second robot 11 approach each other to grip the sandwiches 3*a* and 3*b*, the distance D between the tong members 37 of the first robot 9 and the tong members 37 of the second robot 11 may be set to be larger than that in a case where the dimension of the tong members 37 of the first robot 9 and the second robot 11 is equal to the dimension of the sandwiches 3*a* and 3*b*.

FIGS. 6 and 7 illustrate an operation when the third robot 15 grips the sandwich 3 temporarily placed on the temporary placement apparatus 13 with the tong members 38. Since the third robot 15 performs the packaging of the sandwiches 3*a* and 3*b* into the bag 5, the tong members 38 (an example of second tong members) are formed such that the shape and the dimension of the tips of the tong members 38 are substantially equal to those of the sandwich 3 as illustrated in FIGS. 6 and 7, so as to package the sandwich 3 tightly to the tip of the bag 5. That is, the dimension of the tong members 38 of the third robot 15 is larger than that of the tong members 37 of the first robot 9 and the second robot 11. The third robot 15 clamps the sandwich 3 in the manner of covering the substantially entire surfaces of both sides of the sandwich 3 in the layering direction with the tong members 38.

3. Configuration of Temporary Placement Apparatus

Figure 8:
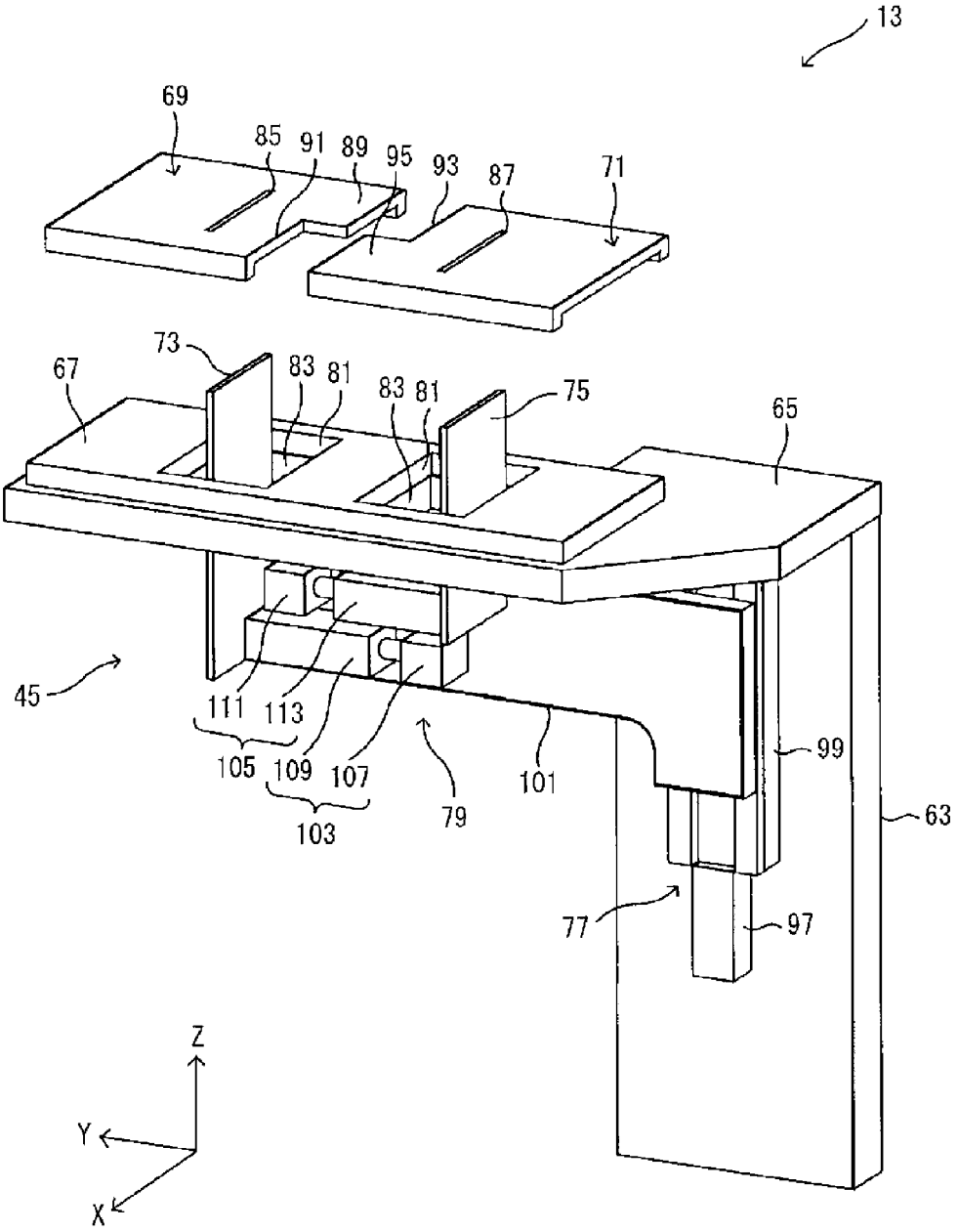
FIG. 8 is an exploded perspective view illustrating an example of an overall configuration of the temporary placement apparatus in which movable plates are exploded.

Next, an example of the overall configuration of the temporary placement apparatus 13 will be described with reference to FIGS. 8 and 9. FIG. 8 is an exploded perspective view illustrating an example of the overall configuration of the temporary placement apparatus 13 in which movable plates are exploded, and FIG. 9 is a perspective view illustrating an example of the overall configuration of the temporary placement apparatus 13.

Figure 9:
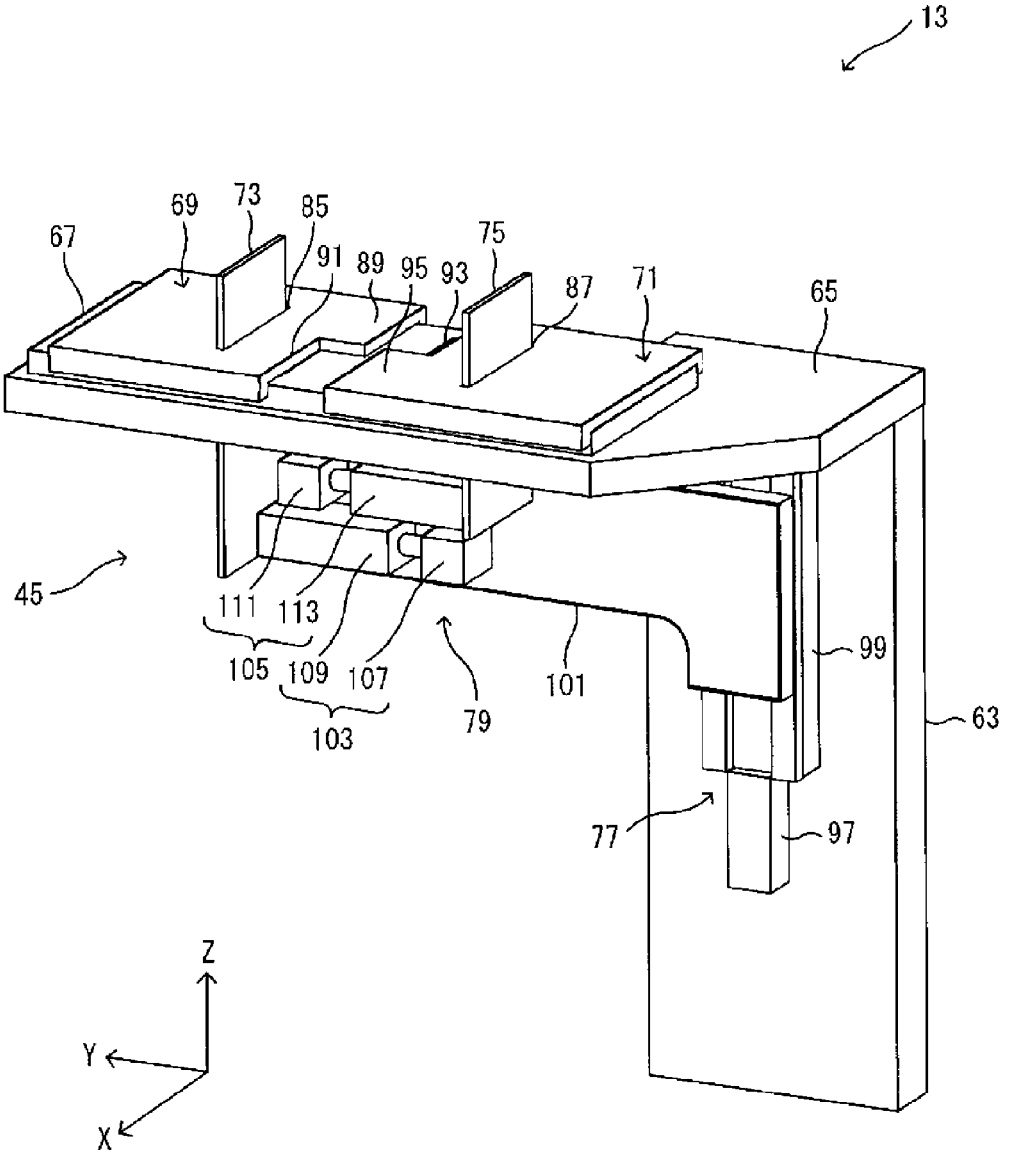
FIG. 9 is a perspective view illustrating an example of the overall configuration of the temporary placement apparatus.

As illustrated in FIGS. 8 and 9, the temporary placement apparatus 13 includes a vertical base 63, a horizontal base 65, and the spacing reduction mechanism 45 described above. The vertical base 63 is a plate-shaped member that has a substantially rectangular shape when viewed from the conveyance direction (the X-axis direction) (the shape is not limited, and a plurality of fine pins or the like may be used), and is provided to stand straight substantially vertically (in the Z-axis direction) beside the carrier conveyor 7. The horizontal base 65 is a plate-shaped member that has a substantially L shape when viewed from above, is supported in a cantilever shape by the vertical base 63, and extends substantially horizontally to project above the carrier conveyor 7. The temporary placement apparatus 13 is installed such that the extension direction of the horizontal base 65 substantially coincides with the width direction of the carrier conveyor 7 (the Y-axis direction).

The spacing reduction mechanism 45 includes a rail 67, a pair of movable plates 69 and 71, a pair of clamping plates 73 and 75, a vertical driving actuator 77, and an opening/closing driving actuator 79.

The rail 67 is a substantially rectangular plate-shaped member formed to protrude upward from the upper surface of the horizontal base 65. The extension direction of the rail 67 substantially coincides with the extension direction of the horizontal base 65, that is, the width direction of the carrier conveyor 7 (the Y-axis direction). Two openings 81 are formed in the rail 67. The openings 81 communicate with openings 83 formed at the corresponding positions of the horizontal base 65, and each of the clamping plates 73 and 75 is inserted through the openings 81 and 83.

The movable plates 69 and 71 are substantially rectangular plates provided with uneven shapes at the sides thereof close to each other. The movable plates 69 and 71 are disposed on the rail 67, and slide on the rail 67 so as to be movable close to or away from each other substantially horizontally in the width direction of the carrier conveyor 7 (the Y-axis direction). In the present embodiment, for the convenience of descriptions, the movable plate 69 will be appropriately described as a first movable plate 69, and the movable plate 71 will be appropriately described as a second movable plate 71. An elongated slit-shaped opening 85 is formed in the first movable plate 69, and the clamping plate 73 is inserted through the opening 85. Similarly, an elongated slit-shaped opening 87 is formed in the second movable plate 71, and the clamping plate 75 is inserted through the opening 87. The first movable plate 69 includes a first protrusion 89 and a first recess 91 at the side thereof close to the second movable plate 71, and the second movable plate 71 includes a second recess 93 and a second protrusion 95 at the side thereof close to the first movable plate 69. When the first movable plate 69 and the second movable plate 71 approach each other, at least a portion of the first protrusion 89 is accommodated in the second recess 93, and at least a portion of the second protrusion 95 is accommodated in the first recess 91.

The clamping plates 73 and 75 are substantially rectangular plates provided to stand straight substantially vertically (in the Z-axis direction), and clamp the sandwiches 3*a* and 3*b* placed on the movable plates 69 and 71 from both sides of the sandwiches 3*a* and 3*b* in the layering direction (in the width direction of the carrier conveyor 7, the Y-axis direction). In the present embodiment, for the convenience of descriptions, the clamping plate 73 will be appropriately described as a first clamping plate 73, and the clamping plate 75 will be appropriately described as a second clamping plate 75. The first clamping plate 73 is inserted into the opening 85 formed in the first movable plate 69 through the openings 83 and 81, and a portion of the upper side thereof protrudes upward from the first movable plate 69. Similarly, the second clamping plate 75 is inserted into the opening 87 formed in the second movable plate 71 through the openings 83 and 81, and a portion of the upper side thereof protrudes upward from the second movable plate 71. The first clamping plate 73 moves in the Y-axis direction within the region of the openings 83 and 81 by the opening/closing driving actuator 79. Along with the movement of the first clamping plate 73, the first movable plate 69 through which the first clamping plate 73 is inserted also moves in the Y-axis direction. Similarly, the second clamping plate 75 moves in the Y-axis direction within the region of the openings 83 and 81 by the opening/closing driving actuator 79. Along with the movement of the second clamping plate 75, the second movable plate 71 through which the second clamping plate 75 is inserted also moves in the Y-axis direction.

The vertical driving actuator 77 (an example of a first actuator) is installed on the surface of the vertical base 63 downstream in the conveyance direction. The vertical driving actuator 77 includes a motor 97 and a linear movement mechanism 99 that extends along the substantially vertical direction (the Z-axis direction). The linear movement mechanism 99 includes, for example, a ball screw mechanism (not illustrated) therein, and converts the rotation movement of the motor 97 into a linear movement to move a slide base 101 vertically in the Z-axis direction. The slide base 101 is a plate-shaped member that has a substantially L shape when viewed in the conveyance direction (the X-axis direction), is supported in a cantilever shape by the vertical driving actuator 77, and extends substantially horizontally to project above the carrier conveyor 7. With the driving of the vertical driving actuator 77, the clamping plates 73 and 75 installed on the slide base 101 via the opening/closing driving actuator 79 move in the Z-axis direction.

The opening/closing driving actuator 79 (an example of a second actuator) includes two horizontal driving actuators 103 and 105 installed close to the tip of the slide base 101. In the present embodiment, for the convenience of descriptions, the horizontal driving actuator 103 will be appropriately described as a first horizontal driving actuator 103, and the horizontal driving actuator 105 will be appropriately described as a second horizontal driving actuator 105. The first horizontal driving actuator 103 includes a motor 107 and a linear movement mechanism 109 that extends along the width direction (the Y-axis direction). The motor 107 is fixed to the slide base 101. The linear movement mechanism 109 includes, for example, a ball screw mechanism (not illustrated) therein, and converts the rotation movement of the motor 107 into a linear movement to move horizontally in the Y-axis direction together with the first clamping plate 73 connected to the end of the linear movement mechanism 109. Similarly, the second horizontal driving actuator 105 includes a motor 111 and a linear movement mechanism 113 that extends along the width direction (the Y-axis direction). The motor 111 is fixed to the slide base 101. The linear movement mechanism 113 includes, for example, a ball screw mechanism (not illustrated) therein, and converts the rotation movement of the motor 111 into a linear movement to move horizontally in the Y-axis direction together with the second clamping plate 75 connected to the end of the linear movement mechanism 113. By the driving of the horizontal driving actuators 103 and 105, the clamping plates 73 and 75 are driven to be closed/opened in the manner that the clamping plates 73 and 75 move close to or away from each other substantially horizontally. Further, since the clamping plates 73 and 75 are independently driven by the two actuators 103 and 105, respectively, the clamping plates 73 and 75 are movable independently from each other, for example, with different movement amounts or at different movement speeds.

The above-described configuration of the temporary placement apparatus 13 is an example, and is not limited to the descriptions above. For example, the opening/closing driving actuator 79 may be configured by a single actuator, using a rack-and-pinion mechanism or the like.

Figure 10:
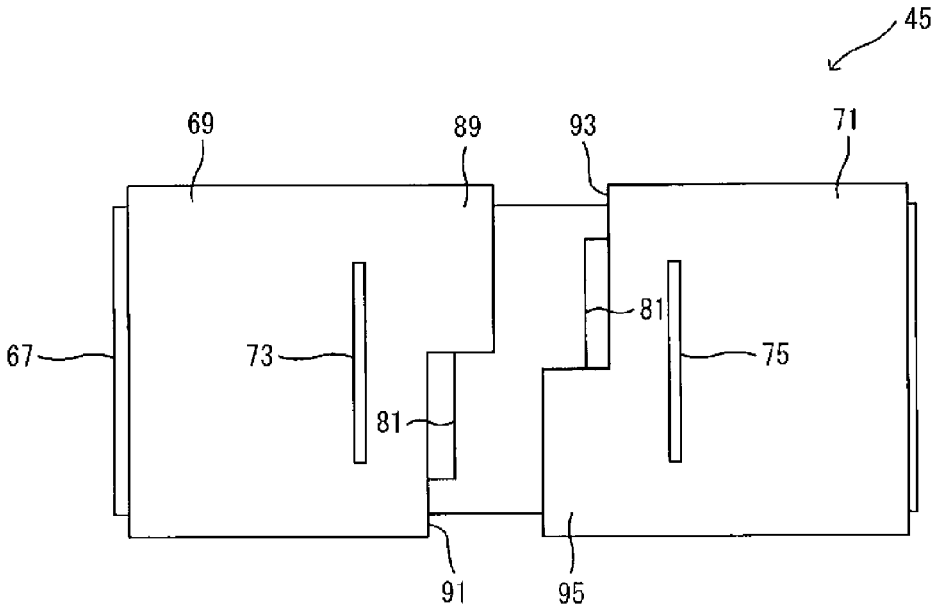
FIG. 10 is a top view illustrating an example of an operation of a spacing reduction mechanism.

4. Operation of Spacing Reduction Mechanism of Temporary Placement Apparatus Next, an example of the operation of the spacing reduction mechanism 45 of the temporary placement apparatus 13 will be described with reference to FIGS. 10 to 20. FIGS. 10, 15, and 17 are top views illustrating an example of the operation of the spacing reduction mechanism 45, and FIGS. 11 to 14, 16, and 18 to 20 are side views illustrating an example of the operation of the spacing reduction mechanism 45. Further, for the convenience of descriptions, FIGS. 10 to 20 illustrate the rail 67, the movable plates 69 and 71, and the clamping plates 73 and 75 which are extracted from the spacing reduction mechanism 45, and omit the illustration of the rest components.

Figure 11:
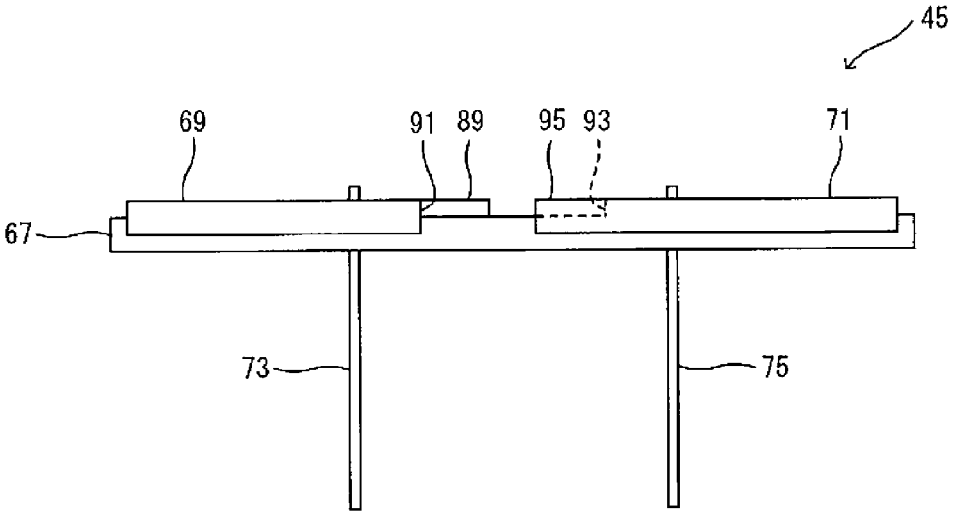
FIG. 11 is a side view illustrating the example of the operation of the spacing reduction mechanism.

As illustrated in FIGS. 10 and 11, when the sandwiches 3*a* and 3*b* are placed on the movable plates 69 and 71 of the temporary placement apparatus 13, the clamping plates 73 and 75 are opened such that the movable plates 69 and 71 are spaced greatly apart from each other, and the clamping plates 73 and 75 move downward. In the example illustrated in FIG. 11, in order to ensure the caught between the clamping plates 73 and 75 and the movable plates 69 and 71, the upper end portions of the clamping plates 73 and 75 that have moved downward slightly protrude from the upper surfaces of the movable plates 69 and 71. However, the upper end portions of the clamping plates 73 and 75 may not protrude from the upper surfaces of the movable plates 69 and 71.

Figure 12:
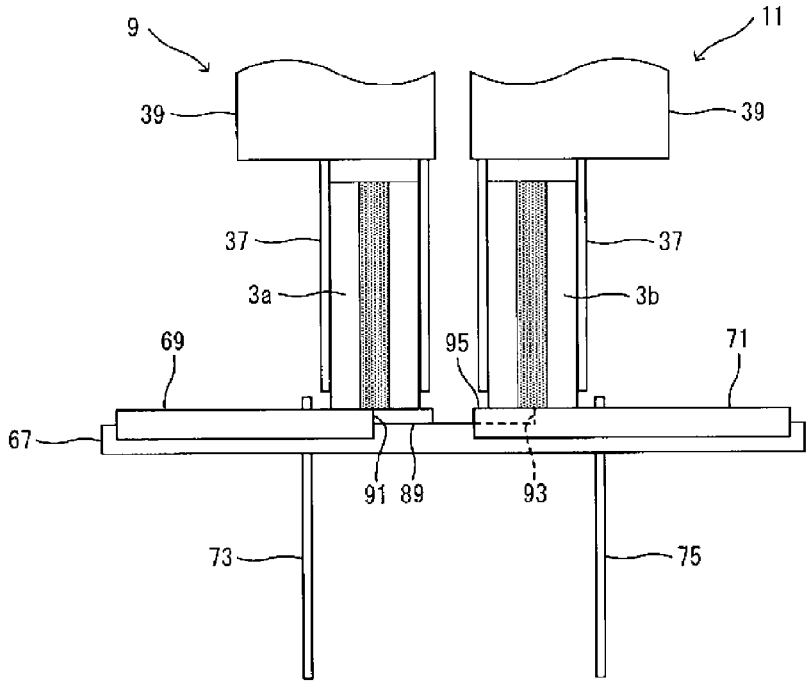
FIG. 12 is a side view illustrating the example of the operation of the spacing reduction mechanism.

Next, as illustrated in FIG. 12, the sandwich 3*a* gripped by the tong members 37 of the first robot 9 is placed in the vertical posture on the first movable plate 69, and the sandwich 3*b* gripped by the tong members 37 of the second robot 11 is placed in the vertical posture on the second movable plate 71. Since the placing operations are performed simultaneously in parallel by the two robots 9 and 11, the sandwiches 3*a* and 3*b* are placed with the predetermined spacing in the layering direction, in order to avoid the interference between the gripper devices 39 or the tong members 37 of the robots 9 and 11. In the example illustrated in FIG. 12, the sandwich 3*a* is placed, for example, in the middle between the first clamping plate 73 and the tip of the first protrusion 89 on the first movable plate 69, and the sandwich 3*b* is placed, for example, in the middle between the second clamping plate 75 and the tip of the second protrusion 95 on the second movable plate 71.

Figure 13:
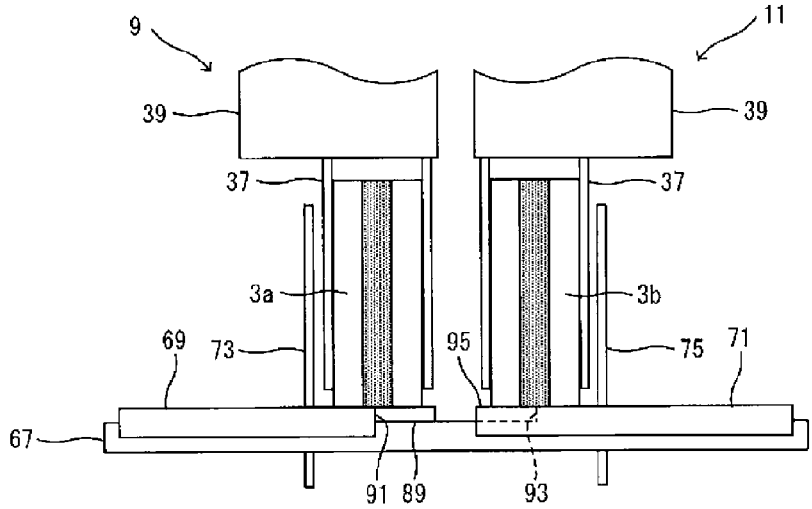
FIG. 13 is a side view illustrating the example of the operation of the spacing reduction mechanism.

Next, as illustrated in FIG. 13, the clamping plates 73 and 75 move upward in a state where the tong members 37 of the robot 9 and the tong members 37 of the robot 11 grip the sandwiches 3*a* and 3*b*, respectively, such that the clamping plates 73 and 75 protrude greatly from the upper surfaces of the movable plates 69 and 71 at both sides of the sandwiches 3*a* and 3*b* in the layering direction. The protruding heights of the clamping plates 73 and 75 are set to be higher than, for example, half the heights of the sandwiches 3*a* and 3*b*.

Figure 14:
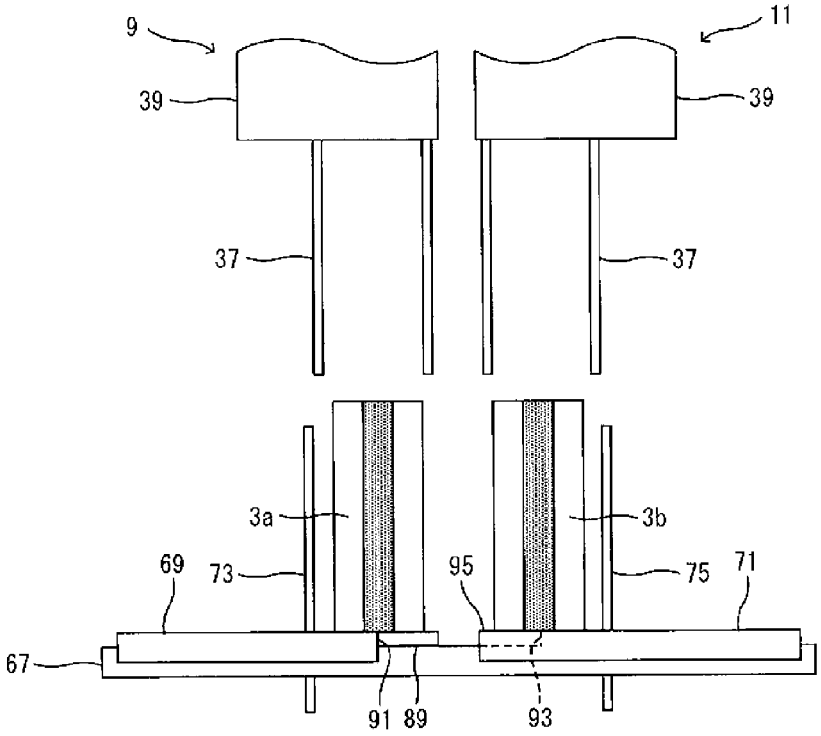
FIG. 14 is a side view illustrating the example of the operation of the spacing reduction mechanism.
Figure 15:
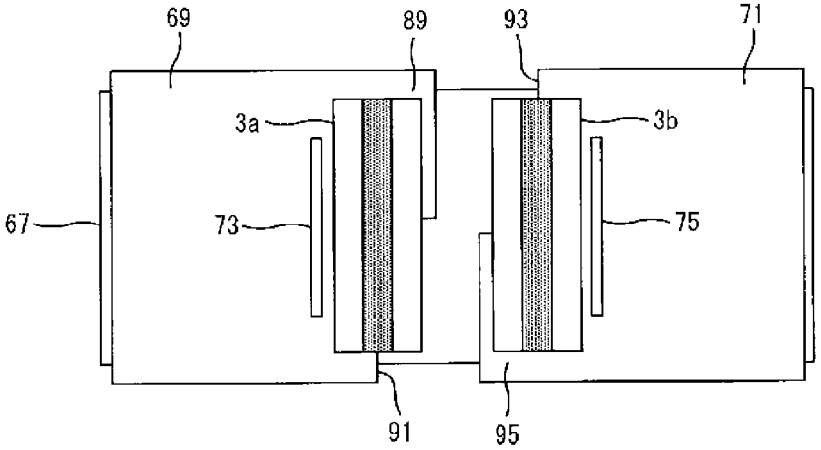
FIG. 15 is a top view illustrating the example of the operation of the spacing reduction mechanism.

Next, as illustrated in FIG. 14, the robots 9 and 11 open the tong members 37, respectively, to the extent that the tong members 37 do not interfere with the clamping plates 73 and 75, to release the sandwiches 3*a* and 3*b*, and pull the tong members 37 upward. Accordingly, as illustrated in FIG. 15, the sandwich 3*a* stands on its own in the middle between the first clamping plate 73 and the tip of the first protrusion 89 on the first movable plate 69, and the sandwich 3*b* stands on its own in the middle between the second clamping plate 75 and the tip of the second protrusion 95 on the second movable plate 71. Even when each of the sandwiches 3*a* and 3*b* may not stand on its own, the clamping plates 73 and 75 may prevent the sandwiches 3*a* and 3*b* from falling down.

Figure 16:
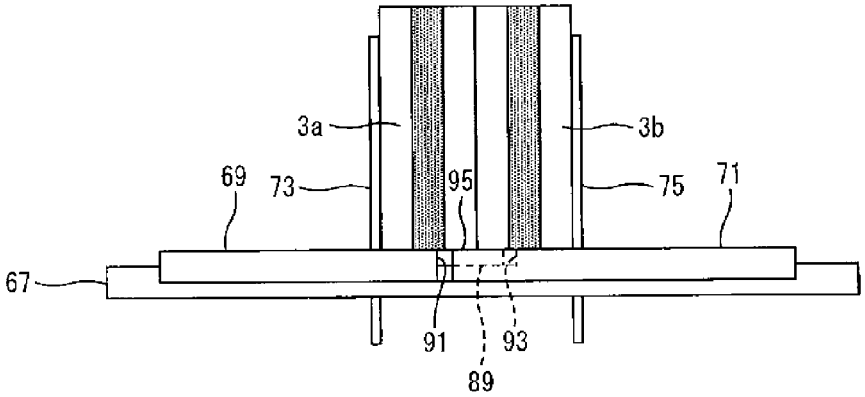
FIG. 16 is a side view illustrating the example of the operation of the spacing reduction mechanism.
Figure 17:
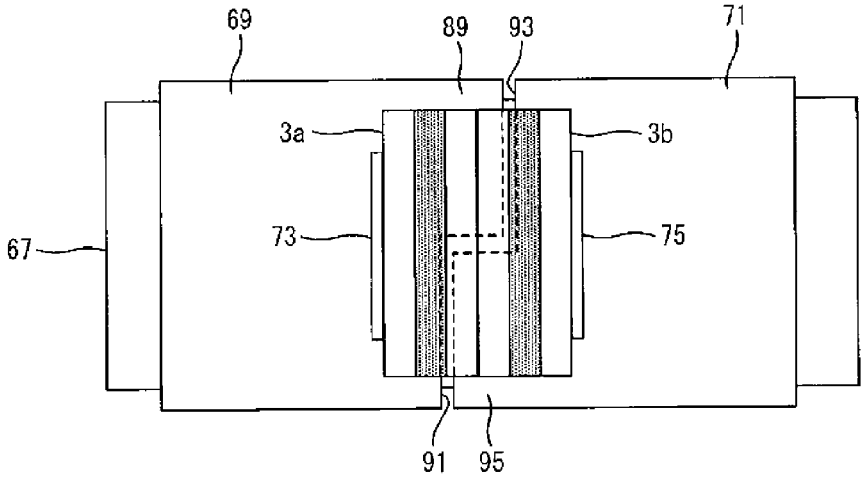
FIG. 17 is a top view illustrating the example of the operation of the spacing reduction mechanism.

Next, as illustrated in FIGS. 16 and 17, the clamping plates 73 and 75 are closed, and the movable plates 69 and 71 approach each other such that at least a portion of the first protrusion 89 is accommodated in the second recess 93, and at least of a portion of the second protrusion 95 is accommodated in the first recess 91. Accordingly, the spacing between the sandwiches 3*a* and 3*b* is reduced, and the sandwiches 3*a* and 3*b* come into close contact with each other without the spacing. At this time, as illustrated in FIG. 17, a predetermined gap remains between the movable plates 69 and 71 in the X-axis direction and the Y-axis direction, so that the movable plates 69 and 71 are movable smoothly in the Y-axis direction while avoiding the contact therebetween. In this state, the detection camera 23 described above captures an image of the tips of the sandwiches 3*a* and 3*b* downstream in the conveyance direction, to detect whether the sandwiches 3*a* and 3*b* are aligned.

In the present embodiment, the dimension of the movable plates 69 and 71 or the stroke of the movable plates 69 and 71 in the Y-axis direction is designed to be dedicated for the dimension of the sandwiches 3*a* and 3*b* in the layering direction, and the sandwiches 3*a* and 3*b* come into close contact with each other when the movable plates 69 and 71 approach each other with the predetermined gap in order to avoid the contact or collision between the movable plates 69 and 71. The present disclosure is not limited to this configuration, and the movable plates 69 and 71 may be configured to be brought into contact with each other. In this case, an elastic body such as a spring or rubber or a flexible material such as a sponge may be provided between the movable plates 69 and 71, such that when the movable plates 69 and 71 collide with each other, the elastic body or the flexible material may be compressed to absorb the impact.

Figure 18:
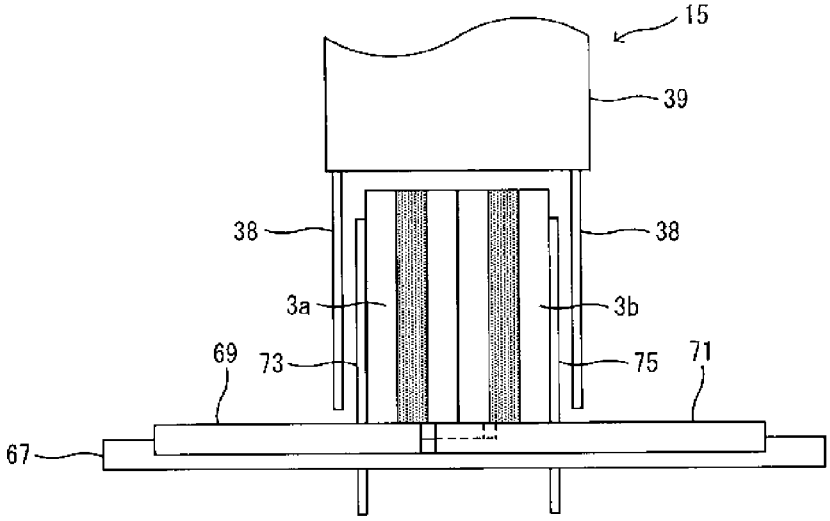
FIG. 18 is a side view illustrating the example of the operation of the spacing reduction mechanism.

Next, as illustrated in FIG. 18, the tong members 38 of the third robot 15 move to the temporary placement apparatus 13, and are positioned at both sides of the sandwiches 3*a* and 3*b* spacing-reduced by the spacing reduction mechanism 45 in the layering direction. Further, the tong members 38 of the third robot 15 are opened to the extent that the tong members 38 do not interfere with the clamping plates 73 and 75.

Figure 19:
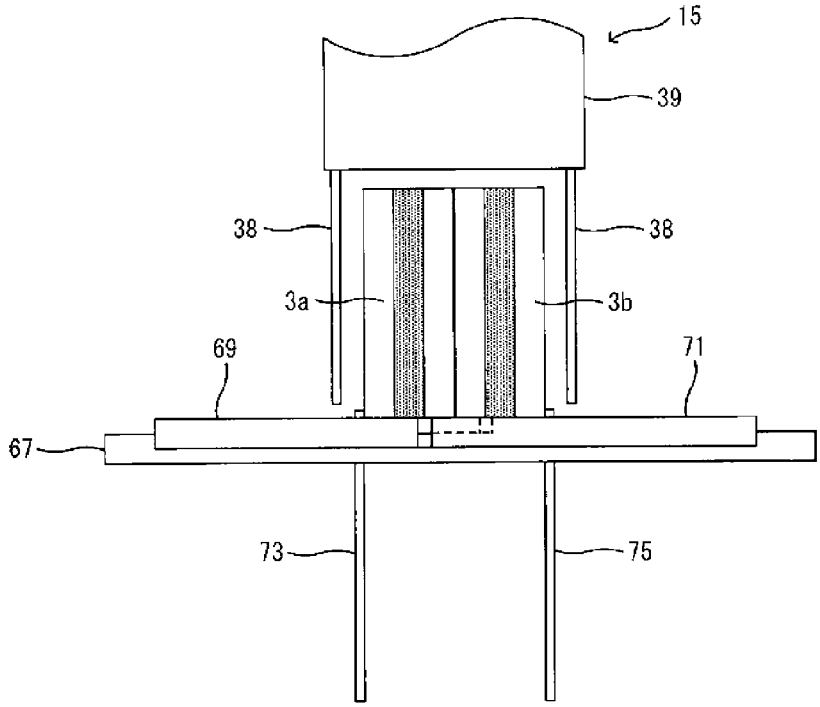
FIG. 19 is a side view illustrating the example of the operation of the spacing reduction mechanism.

Next, as illustrated in FIG. 19, the clamping plates 73 and 75 move downward, inside the tong members 38 of the third robot 15. At this time, even when each of the sandwiches 3*a* and 3*b* does not stand on its own, the tong members 38 of the third robot 15 may prevent the sandwiches 3*a* and 3*b* from falling down.

Figure 20:
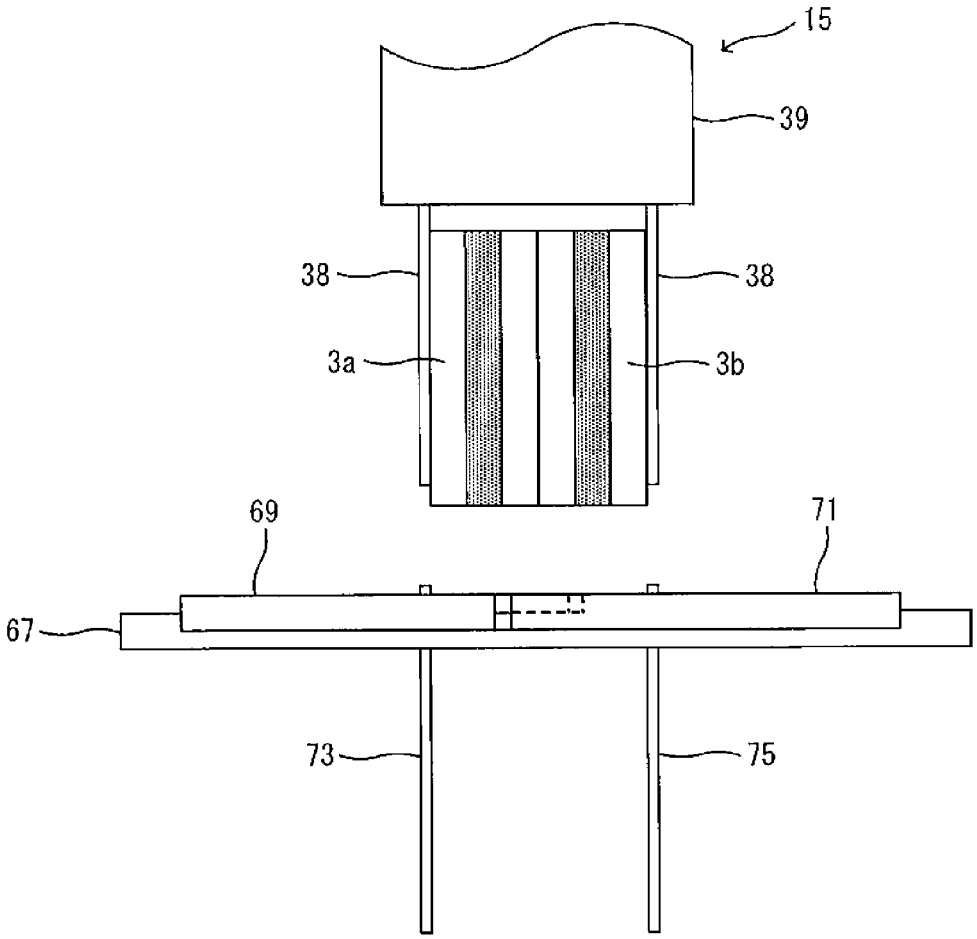
FIG. 20 is a side view illustrating the example of the operation of the spacing reduction mechanism.

Next, as illustrated in FIG. 20, the third robot 15 closes the tong members 38 to grip the sandwiches 3*a* and 3*b*, and lifts the sandwiches 3*a* and 3*b* from the movable plates 69 and 71. When the host controller 19 determines to perform the packaging based on the result of the image capturing by the detection camera 23 as described above, the third robot 15 inserts the sandwiches 3*a* and 3*b* into the bag 5. Meanwhile, when the host controller 19 determines not to perform the packaging, the third robot 15 discards the sandwiches 3*a* and 3*b*.

5. Functional Configuration of Host Controller

Figure 21:
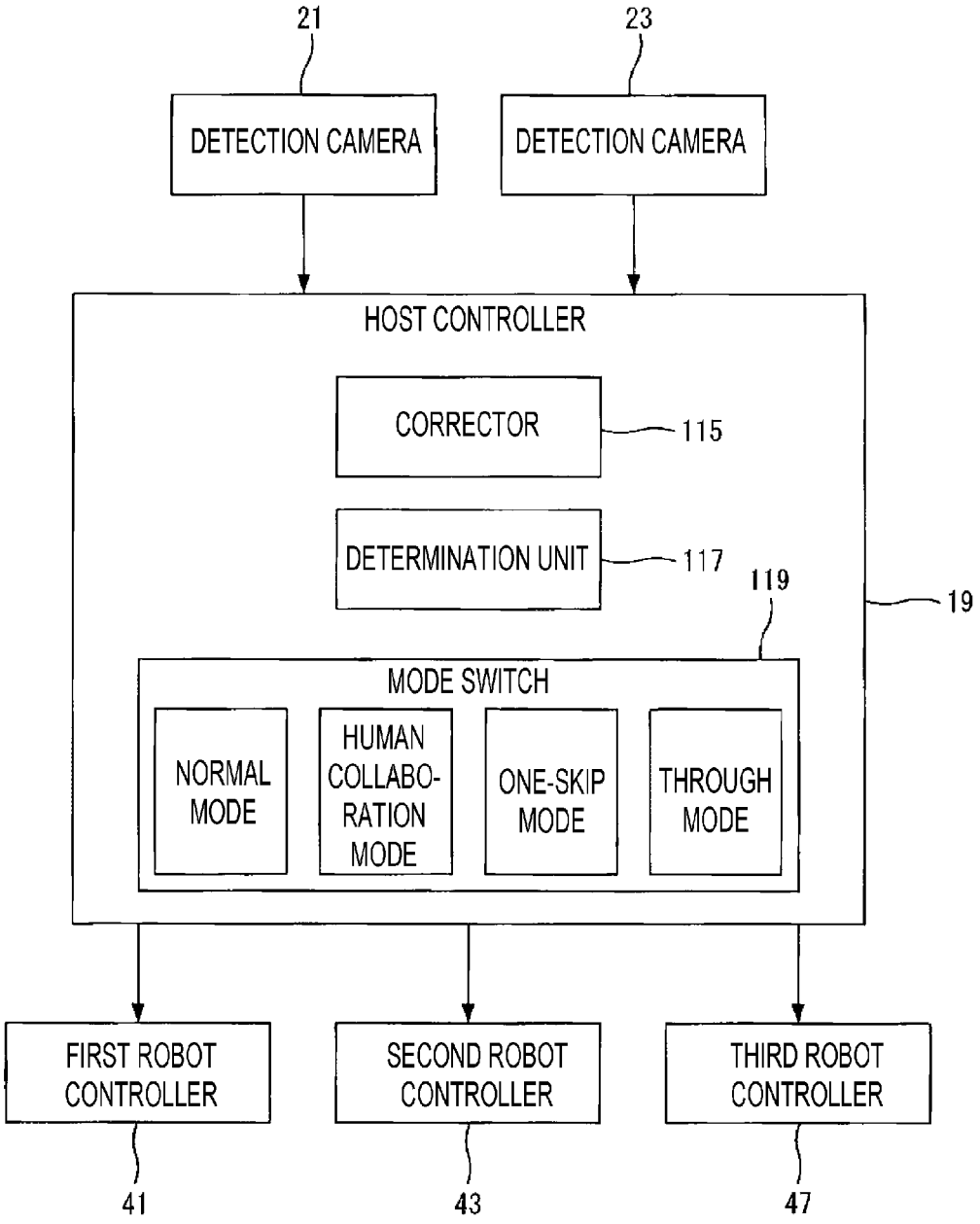
FIG. 21 is a block diagram illustrating an example of a functional configuration of a host controller.

Next, an example of the functional configuration of the host controller 19 will be described with reference to FIG. 21. FIG. 21 is a block diagram illustrating an example of the functional configuration of the host controller 19.

As illustrated in FIG. 21, the host controller 19 includes a corrector 115, a determination unit 117, and a mode switch 119.

The detection camera 21 captures an image of the conveyed sandwich 3 from above at the image capturing position IP, and transmits the image capturing result to the host controller 19. The corrector 115 of the host controller 19 detects a positional deviation of each of the sandwiches 3*a* and 3*b* from a reference position in the X-axis direction, the Y-axis direction, and the θ direction through an image analyzing process, and corrects position commands to be transmitted to the first robot controller 41 and the second robot controller 43 based on the detected positional deviation, so as to control the gripping operations by the first robot 9 and the second robot 11.

The detection camera 23 captures an image of the tips of the sandwiches 3*a* and 3*b* spacing-reduced by the spacing reduction mechanism 45 of the temporary placement apparatus 13 downstream in the conveyance direction, and transmits the image capturing result to the host controller 19. The determination unit 117 of the host controller 19 detects whether the tips of the sandwiches 3*a* and 3*b* are aligned through an image analyzing process, and determines whether to perform the packaging of the sandwiches 3*a* and 3*b* based on the detection result. The determination unit 117 determines to perform the packaging when the tips of the sandwiches 3*a* and 3*b* are aligned, and determines not to perform the packaging when the tips of the sandwiches 3*a* and 3*b* are not aligned. When the determination unit 117 determines to perform the packaging, the third robot controller 47 controls the third robot 15 to grip the sandwiches 3*a* and 3*b* and insert the sandwiches 3*a* and 3*b* into the bag 5, based on a position command received from the host controller 19. Meanwhile, when the determination unit 117 determines not to perform the packaging, the third robot controller 47 controls the third robot 15 to grip the sandwiches 3*a* and 3*b* and discard the sandwiches 3*a* and 3*b*, for example, at a predetermined discarding place, based on a position command received from the host controller 19.

The mode switch 119 switches the operation mode of the sandwich packaging system 1 to one of a normal mode, a human collaboration mode, a one-skip mode, and a through mode. The normal mode (an example of a first mode) is a mode performed when the amount of sandwiches 3 supplied from the previous process is equal to or less than a processing capacity of the sandwich packaging system 1. That is, in the normal mode, all of the sandwiches 3 supplied from the previous process by the first conveyance line 33 of the carrier conveyor 7 are packaged by the respective devices of the sandwich packaging system 1 (the first robot 9, the second robot 11, the temporary placement apparatus 13, the third robot 15, and the bag supply device 17), and the packaged sandwiches 3 are conveyed to the subsequent process by the second conveyance line 35.

The human collaboration mode (an example of the first mode) is a mode performed when the amount of sandwiches 3 supplied from the previous process exceeds the processing capacity of the sandwich packaging system 1. That is, in the human collaboration mode, the sandwiches 3 supplied from the previous process by the first conveyance line 33 of the carrier conveyor 7 are packaged in an amount that may be processed in the respective devices of the sandwich packaging system 1, and the packaged sandwiches 3 are conveyed by the second conveyance line 35. The sandwiches 3 that exceed the processing capacity are not packaged, and are directly conveyed by the first conveyance line 33 such that a manager performs the packaging manually. In this case, the manager may perform the packaging for the sandwiches 3 that are being conveyed by the first conveyance line 33, or may perform the packaging in the subsequent process after the sandwich packaging system 1.

The one-skip mode (an example of the first mode) is a mode performed when the amount of the sandwiches 3 supplied from the previous process exceeds the processing capacity of the sandwich packaging system 1. That is, in the one-skip mode, a slightly long carrier conveyor 7 is installed (two relatively short carrier conveyors 7 may be installed in series), and two sets of the respective devices of the sandwich packaging system 1 (the first robot 9, the second robot 9, the temporary placement apparatus 13, the third robot 15, and the bag supply device 17) are installed in series. Then, the respective devices of the first set grip and package the sandwiches 3 supplied from the previous process by the first conveyance line 33 of the carrier conveyor 7, while alternately skipping the sandwiches 3, and places the packaged sandwiches 3 on the second conveyance line 35. The remaining sandwiches 3 that exceed the processing capacity of the first set are not packaged, and are directly conveyed to the second set by the first conveyance line 33. The respective devices of the second set grip and package the sandwiches 3 that are alternately skipped and conveyed by the first conveyance line 33, and place the packaged sandwiches 3 on empty places of the second conveyance line 35.

The through mode (an example of a second mode) is a mode performed when at least one of the respective devices of the sandwich packaging system 1 is not operable due to, for example, a maintenance or failure. That is, in the through mode, all of the sandwiches 3 supplied from the previous process by the first conveyance line 33 of the carrier conveyor 7 are directly conveyed to the subsequent process by the first conveyance line 33. In this case, a manger may perform the packaging for the sandwiches 3 that are being conveyed by the first conveyance line 33, or may perform the packaging in the subsequent process after the sandwich packaging system 1. Further, a packaging mechanism similar to the sandwich packaging system 1 may be separately installed in the subsequent process, such that the packaging may be performed by the packaging mechanism.

The switching of the operation modes by the mode switch 119 may be performed based on, for example, a manual switching operation by a manager, or automatically performed based on, for example, a detection signal by a camera, a sensor or the like, or an abnormality signal such as an error or an alarm.

The distribution of the processes and others performed in the corrector 115, the determination unit 117, the mode switch 119 and others described above is not limited to the example described above, and, for example, the processes and others may be performed by a relatively fewer number of processing units (e.g., one processing unit) or may be performed by further subdivided processing units. Further, each processing unit of the host controller 19 may be implemented by a program executed by a CPU 901 (see, e.g., FIG. 26) to be described later, or a portion or all of the processing units of the host controller 19 may be implemented by an actual device such as an ASIC, an FPGA, or other electric circuits. Further, the distribution of the processes performed by the host controller 19 and the robot controllers 41, 43, and 47 is not limited to the example described above, and, for example, a portion or all of the processes performed by the corrector 115, the determination unit 117, the mode switch 119 and others may be performed by the robot controllers 41, 43, and 47.

6. Operation State of Sandwich Packaging System in Each Operation Mode

Figure 22:
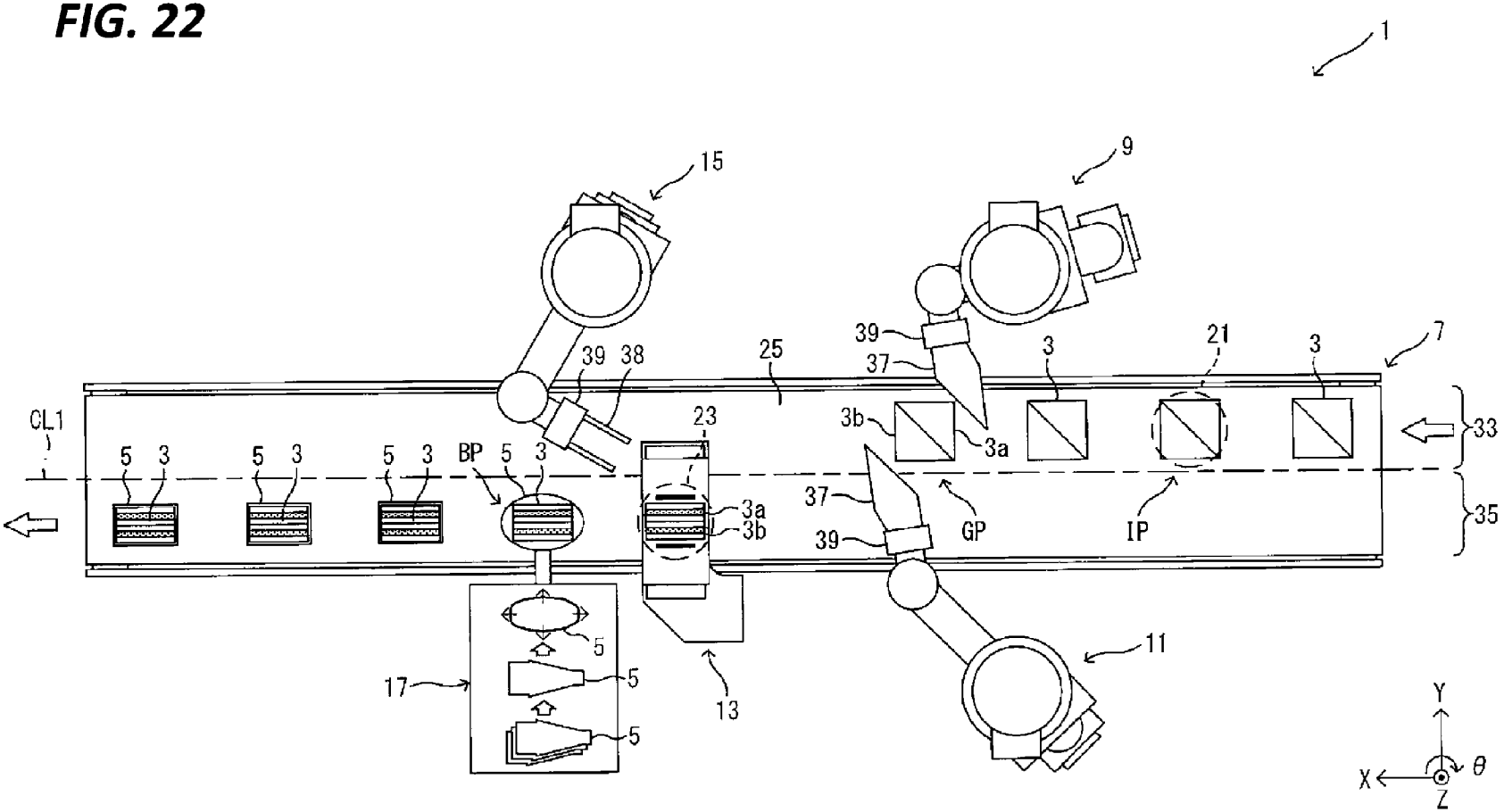
FIG. 22 is a top view illustrating an example of an operation state of the sandwich packaging system in a normal mode.

Next, an example of the operation state of the sandwich packaging system 1 in each operation mode will be described with reference to FIGS. 22 to 25. FIG. 22 is a top view illustrating an example of the operation state of the sandwich packaging system 1 in the normal mode, FIG. 23 is a top view illustrating an example of the operation state of the sandwich packaging system 1 in the human collaboration mode, FIG. 24 is a top view illustrating an example of the operation state of the sandwich packaging system 1 in the one-skip mode, and FIG. 25 is a top view illustrating an example of the operation state of the sandwich packaging system 1 in the through mode.

As illustrated in FIG. 22, in the normal mode, all of the sandwiches 3 supplied from the previous process by the first conveyance line 33 of the carrier conveyor 7 are packaged by the respective devices of the sandwich packaging system 1 (the first robot 9, the second robot 11, the temporary placement apparatus 13, the third robot 15, and the bag supply device 17), and the packaged sandwiches 3 are conveyed to the subsequent process by the second conveyance line 35. Further, as described above, the sandwiches 3 determined by the host controller 19 not to be packaged based on the result of the image capturing by the detection camera 23 are discarded.

Figure 23:
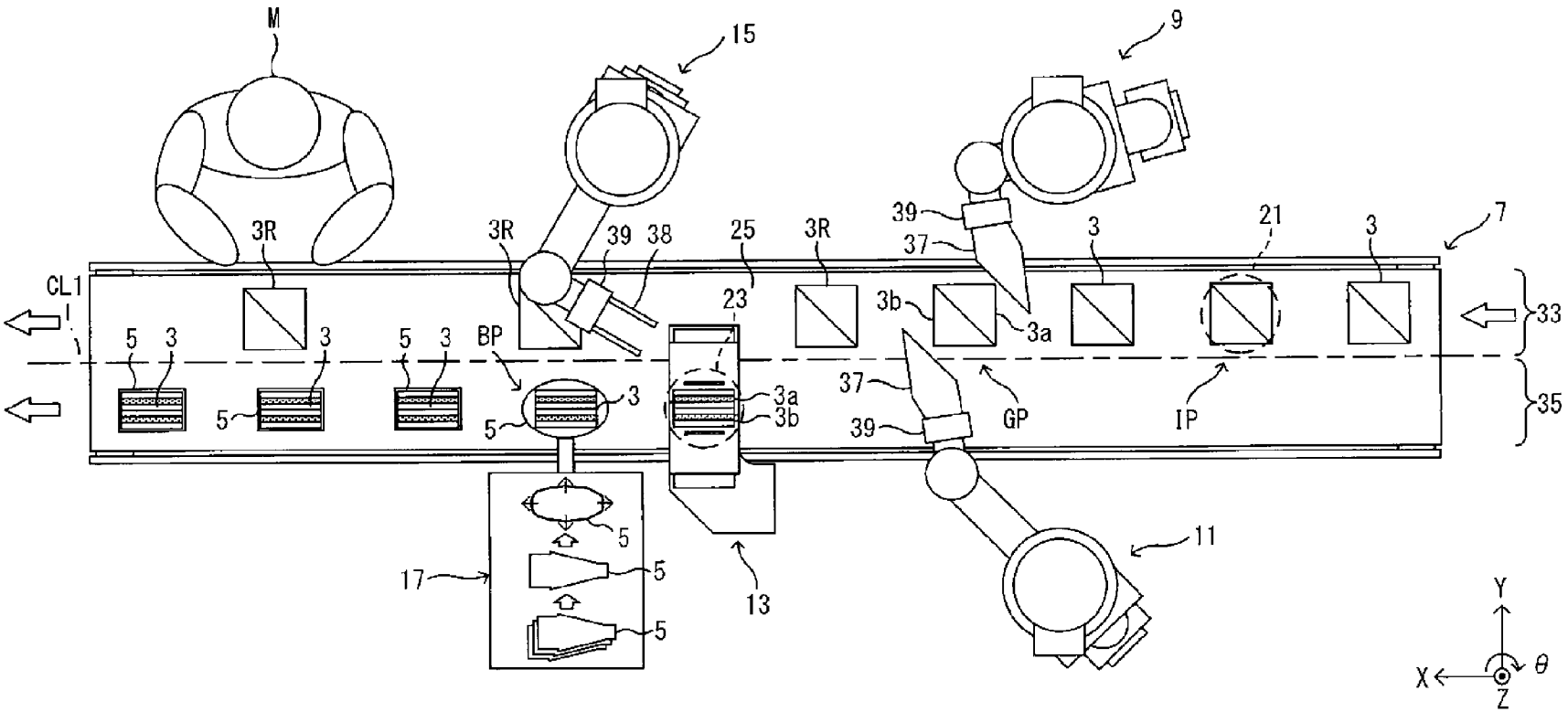
FIG. 23 is a top view illustrating an example of an operation state of the sandwich packaging system in a human collaboration mode.

As illustrated in FIG. 23, in the human collaboration mode, the sandwiches 3 supplied from the previous process by the first conveyance line 33 of the carrier conveyor 7 are packaged in an amount that may be processed by the respective devices of the sandwich packaging system 1, and are conveyed by the second conveyance line 35. The remaining sandwiches 3R that exceed the processing capacity are not packaged and are directly conveyed by the first conveyance line 33, such that a manager M performs the packaging manually. While FIG. 23 illustrates a case where the manager M performs the packaging for the sandwiches 3 that are being conveyed by the first conveyance line 33, the manager M may perform the packaging in the subsequent process after the sandwich packaging system 1.

Figure 24:
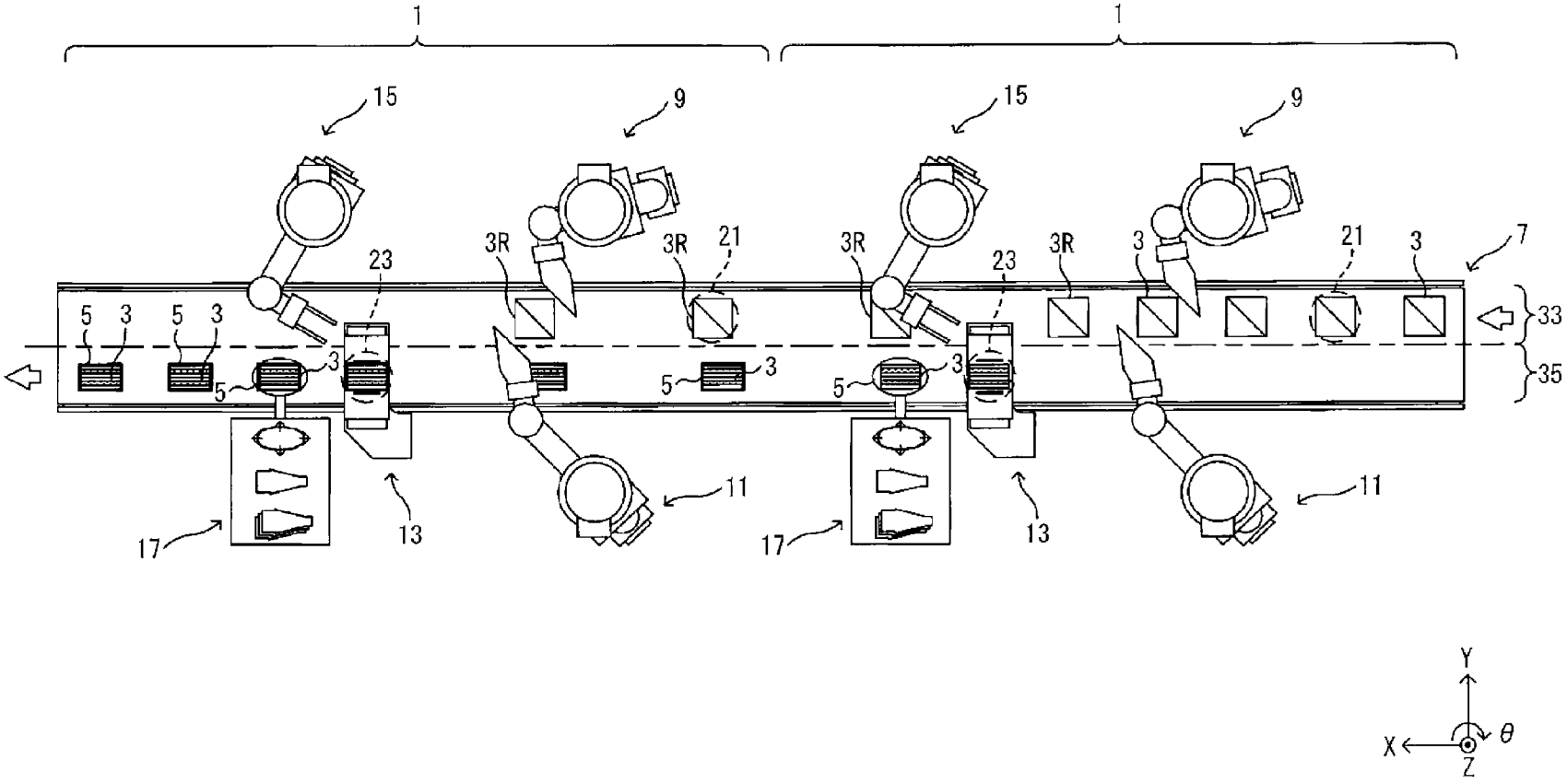
FIG. 24 is a top view illustrating an example of an operation state of the sandwich packaging system in a one-skip mode.
Figure 25:
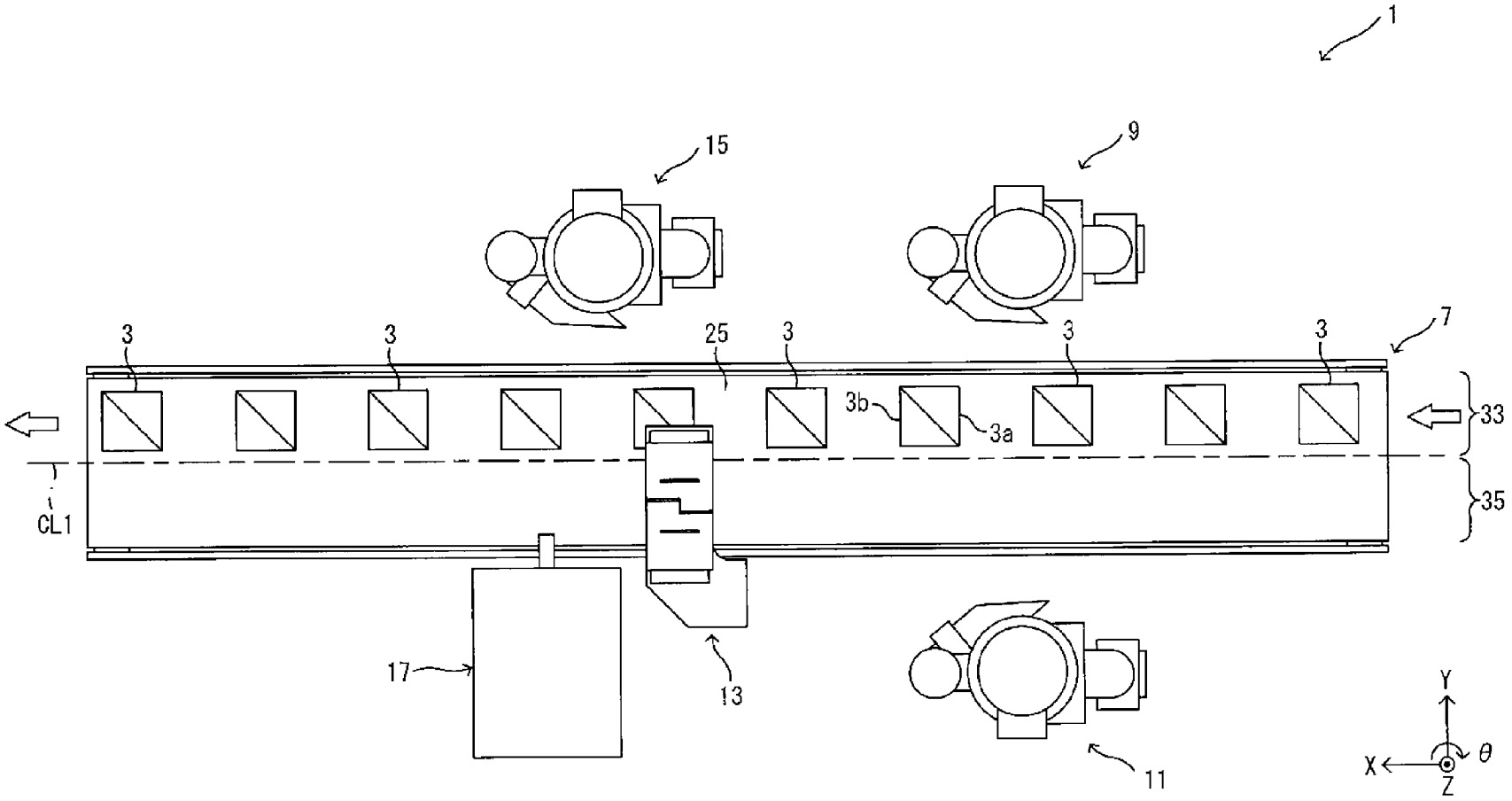
FIG. 25 is a top view illustrating an example of an operation state of the sandwich packaging system in a through mode.

As illustrated in FIG. 24, in the one-skip mode, two sets of the respective devices of the sandwich packaging system 1 (the first robot 9, the second robot 11, the temporary placement apparatus 13, the third robot 15, and the bag supply device 17) are installed in series in the conveyance direction of the carrier conveyor 7. Then, the respective devices of the first set grip and package the sandwiches 3 supplied from the previous process by the first conveyance line 33 of the carrier conveyor 7, while alternately skipping the sandwiches 3, and place the packaged sandwiches 3 on the second conveyance line 35. The remaining sandwiches 3R that exceed the processing capacity of the first set are not packaged and are directly conveyed to the second set by the first conveyance line 33. The respective devices of the second set grip and package the sandwiches 3R that are alternately skipped and conveyed by the first conveyance line 33, and place the packaged sandwiches 3 on empty places on the second conveyance line 35. In this way, even in a case where sandwiches may not be handled by one set of the sandwich packaging system 1 due to the production takt time, the sandwiches may be simply handled by installing two sets of the respective devices of the sandwich packaging system 1 in series. Further, three or more sets of the respective devices of the sandwich packaging system 1 may be installed according to the production takt time of the sandwiches 3. In this case, for example, another conveyor machine, and a control device or software for distributing works are unnecessary, so that it is possible to prevent the cost increase and the complexity in the production line. Further, since the sets of devices may be installed in series, rather than being installed in parallel, the expansion of the width of the line may be prevented, so that the sets of devices may be installed in the current production line.

As illustrated in FIG. 25, in the through mode, all of the sandwiches 3 supplied from the previous process by the first conveyance line 33 of the carrier conveyor 7 are not packaged and are directly conveyed to the subsequent process by the first conveyance line 33. In this case, a manager may perform the packaging for the sandwiches 3 that are being conveyed by the first conveyance line 33, or may perform the packaging in the subsequent process after the sandwich packaging system 1. Further, a packaging mechanism similar to the sandwich packaging system 1 may be separately installed in the subsequent process, and the packaging may be performed by the packaging mechanism. As a result, even when the sandwich packaging system 1 is not operable, the sandwich production line may be operated without stopping the entire sandwich production line.

7. Effects of Embodiment

As described above, in the sandwich packaging system 1 of the present embodiment, the carrier conveyor 7 conveys the sandwich 3 in the horizontal posture. The first robot 9 and the second robot 11 grip the sandwich 3 that is being conveyed, lift the sandwich 3 from the carrier conveyor 7, change the horizontal posture into the vertical posture, and temporarily place the sandwich 3 on the temporary placement apparatus 13. Then, the third robot 15 grips the sandwich 3 temporarily placed on the temporary placement apparatus 13, and inserts the sandwich 3 into the bag 5 so as to package the sandwich 3.

In this way, the sandwich 3 may be conveyed in the stable horizontal posture, and it is possible to avoid, for example, conveying a plurality of sandwiches 3 in the horizontal posture in a state of being stacked or conveying the sandwich 3 in the unstable vertical posture, so that the quality of the packaging may be suppressed from being deteriorated due to, for example, an occurrence of a positional deviation.

Further, in a case where the first robot 9 and the second robot 33 grip and lift the sandwich 3 that is being conveyed, and directly insert the sandwich 3 into the bag 5, it may be difficult to adjust the state of gripping the sandwich 3 by the first robot 9 and the second robot 11 to the state suitable for the packaging. Thus, for example, the following problems may occur: the sandwich 3 does not enter the bag 5, the tong members 37 ruin the bag 5, the tong members 37 are stuck in the bag 5, and the sandwich 3 is not packed tightly to the tip of the bag 5.

In the present embodiment, since the system is configured such that the first robot 9 and the second robot 11 temporarily place the sandwich 3 on the temporary placement apparatus 13, and the third robot 15 grips and packages the temporarily placed sandwich 3, the robots that lift the sandwich 3 change. At this time, by temporarily placing the sandwich 3 in the vertical posture in which the layering direction is substantially horizontal, the state of gripping the sandwich 3 by the third robot 15 may be finely adjusted to the state suitable for the packaging, so that the occurrence of the problems described above may be suppressed, and the quality of the packaging may be improved.

In the present embodiment, in particular, the temporary placement apparatus 13 includes the spacing reduction mechanism 45 that reduces the spacing in the layering direction between the plurality of sandwiches 3*a* and 3*b* temporarily placed in the vertical posture, and the third robot 15 grips the plurality of spacing-reduced sandwiches 3*a* and 3*b* and inserts the gripped sandwiches 3*a* and 3*b* into the bag 5.

When the plurality of sandwiches 3*a* and 3*b* are packaged in a state of being stacked in the layering direction, the plurality of sandwiches 3*a* and 3*b* are temporarily placed side by side in the layering direction on the temporary placement apparatus 13, and gripped by the third robot 15. At this time, in order to avoid the interference between the plurality of robots 9 and 11 when the robots 9 and 11 grip and temporarily place the sandwiches 3*a* and 3*b*, the plurality of sandwiches 3*a* and 3*b* may not be temporarily placed in a state of being closely in contact with each other, and the predetermined spacing is formed between the sandwiches 3*a* and 3*b*. Even in a case where the sandwiches 3*a* and 3*b* are temporarily placed in an order by one robot, the predetermined spacing is also formed between the sandwiches 3*a* and 3*b* in order to, for example, secure the space where the tong members 37 are openable/closable.

Here, in a case where the tong members 38 of the third robot 15 are opened wide to grip the sandwiches 3*a* and 3*b* while reducing the spacing between the sandwiches 3*a* and 3*b*, it takes time to perform the operation of widely opening/closing the tong members 38 of the third robot 15, which may deteriorate the cycle time. Further, since a force is applied to move the sandwiches 3*a* and 3*b*, a friction may occur between the sandwiches 3*a* and 3*b* and the placement surfaces of the movable plates 69 and 71, and a deformation or damage may occur in the sandwiches 3*a* and 3*b* which may cause the deterioration of quality.

In the present embodiment, since the temporary placement apparatus 13 includes the spacing reduction mechanism 45, the spacing between the sandwiches 3*a* and 3*b* in the layering direction may be reduced during the time until the third robot 15 moves the tong members 38 to the temporary placement apparatus 13. Accordingly, the cycle time may be reduced (the takt time may be improved). Further, the movable plates 69 and 71 themselves on which the sandwiches 3*a* and 3*b* are placed are moved by the spacing reduction mechanism 45, so that the friction between the sandwiches 3*a* and 3*b* and the placement surfaces may be prevented, and the occurrence of a deformation or damage of the sandwiches 3*a* and 3*b* may be prevented.

In the present embodiment, in particular, the sandwich packaging system 1 further includes the detection camera 23 that captures an image of the sandwiches 3*a* and 3*b* spacing-reduced by the spacing reduction mechanism 45, and the host controller 19 provided with the determination unit 117 that determines whether to perform the packaging of the sandwiches 3*a* and 3*b* based on the result of the image capturing by the detection camera 23. When the determination unit 117 determines to perform the packaging, the third robot 15 grips the spacing-reduced sandwiches 3*a* and 3*b*, and inserts the sandwiches 3*a* and 3*b* into the bag 5.

As a result, when the sandwiches 3*a* and 3*b* are temporarily placed on the temporary placement apparatus 13, and the spacing between the sandwiches 3*a* and 3*b* is reduced, the alignment of the sandwiches 3*a* and 3*b* may be checked, so that the quality of the packaging or the quality of the packaged sandwiches 3*a* and 3*b* may be improved.

In the present embodiment, in particular, the carrier conveyor 7 includes the first conveyance line 33 that conveys the sandwiches 3 supplied from the previous process before the sandwich packaging system 1 toward the gripping position GP where the gripping is performed by the first robot 9 and the second robot 11, and conveys the sandwiches 3 that are not gripped by the first robot 9 and the second robot 11 toward the subsequent process after the sandwich packaging system 1 through the gripping position GP, and the second conveyance line 35 that is disposed adjacent to the first conveyance line 33, and conveys the sandwiches 3 that are gripped by the first robot 9 and the second robot 11 at the gripping position GP of the first conveyance line 33, temporarily placed on the temporary placement apparatus 13, and inserted/packaged into the bag 5.

Accordingly, the sandwich packaging system 1 may be operated in an appropriate aspect according to, for example, the operation status of the production line or the device state of the system, using the two conveyance lines 33 and 35 of the carrier conveyor 7. For example, when the amount of the sandwiches 3 supplied from the previous process exceeds the processing capacity of the sandwich packaging system 1, the sandwiches 3 are packaged in an amount that may be processed by the respective devices of the sandwich packaging system 1, and conveyed by the second conveyance line 35, and the remaining sandwiches 3 that exceed the processing capacity are not packaged and are directly conveyed by the first conveyance line 33, such that a manger may perform the packaging manually or may perform the packaging using the same devices of the second set. Further, for example, even when at least one of the packaging mechanism such as the first robot 9, the second robot 11, the temporary placement apparatus 13, or the third robot 15 is not operable due to a maintenance or failure, the first conveyance line 33 of the carrier conveyor 7 may be operated to convey the sandwiches 3 supplied from the previous process directly to the subsequent process through the sandwich packaging system 1. As a result, for example, the manager M may perform the packaging, so that it is possible to avoid stopping the entire sandwich production line.

In the present embodiment, in particular, two robots are provided to grip the sandwiches 3*a* and 3*b* at the gripping position GP of the carrier conveyor 7. Each of the two robots 9 and 11 moves the pair of tong members 37 toward the direction in which the cut surface CS1 (or CS2) of the sandwich 3*a* (or 3*b*) which is the griping target of the sandwiches 3*a* and 3*b* faces into contact with the cut surface CS2 (or CS1) of the other facing sandwich 3*b* (or 3*a*), and inserts the lower tong member 37 below the sandwich 3*a* (or 3*b*).

Thus, the portion where the cut surface CS of the sandwich 3 at which the ingredients 28 are exposed and the device component are in contact with each other may be reduced as much as possible. As a result, stain caused by the contact may be easily handled by, for example, cleaning the device component, and further, the quality of the layered food in terms of hygiene may be improved.

In the present embodiment, in particular, the third robot 15 includes the pair of tong members 38 that grip the sandwich 3 temporarily placed on the temporary placement apparatus 13, and the dimension of the tong members 37 of the first robot 9 and the second robot 11 is smaller than that of the tong members 38. As a result, the following effects are achieved.

That is, in the present embodiment, the temporary placement apparatus 13 is installed so that the "lifting" of the sandwich 3 by the first robot 9 and the second robot 11 and the "packaging" of the sandwich 3 by the third robot 15 may be separately performed. As a result, the tong members 38 of the third robot 15 may be designed to have the dimension substantially equal to the dimension of the sandwich 3 so as to package the sandwich 3 tightly to the tip of the bag 5, and since the first robot 9 and the second robot 11 do not perform the packaging, the dimension of the tong members 37 may be designed to be one size smaller than that of the tong members 38 of the third robot 15. Accordingly, when the tong members 37 of the first robot 9 and the tong members 37 of the second robot 11 approach each other to grip the sandwiches 3*a* and 3*b*, the distance D between the tong members 37 of the first robot 9 and the tong members 37 of the second robot 11 may be set to be relatively large, and the positioning accuracy of the tong members 37 at the gripping position GP may be alleviated. As a result, the teaching of the first robot 9 and the second robot 11 becomes easy. Further, since the contact between the tong members 37 may be suppressed, the generation of dust caused from the contact may be reduced, and the mixing of foreign matter into the sandwich 3 may be suppressed.

In the present embodiment, in particular, the temporary placement apparatus 13 includes the rail 67, the pair of movable plates 69 and 71 disposed to be movable close to or away from each other substantially horizontally on the rail 67 and configured to place the sandwiches 3*a* and 3*b* thereon, the pair of the clamping plates 73 and 75 that are inserted through the pair of movable plates 69 and 71, respectively, substantially vertically, and clamp the plurality of placed sandwiches 3*a* and 3*b* from both sides of the sandwiches 3*a* and 3*b* in the layering direction, the vertical driving actuator 77 that moves the pair of clamping plates 73 and 75 substantially vertically, and the opening/closing driving actuator 79 that moves the pair of clamping plates 73 and 75 substantially horizontally.

In the spacing reduction mechanism 45 of the present embodiment, the clamping plates 73 and 75 that clamp the sandwiches 3*a* and 3*b* are configured to be opened/closed together with the movable plates 69 and 71 on which the sandwiches 3*a* and 3*b* are placed, so that the occurrence of a friction between the sandwiches 3*a* and 3*b* and the movable plates 69 and 71 may be prevented when the spacing is reduced, and a deformation or damage of the sandwiches 3*a* and 3*b* may be prevented. Further, for example, when the robots 9 and 11 temporarily place the sandwiches 3*a* and 3*b*, or when the third robot 15 grips the spacing-reduced sandwiches 3*a* and 3*b*, the clamping plates 73 and 75 are drawn toward the movable plates 69 and 71, so that the interference between the clamping plates 73 and 75 and the tong members 37 or 38 of each of the robots 9, 11, and 15 may be avoided. Further, at the timing when the tong members 37 of the robots 9 and 11 are pulled up after the sandwiches 3*a* and 3*b* are temporarily placed, the clamping plates 73 and 75 project from the movable plates 69 and 71, so that the sandwiches 3*a* and 3*b* which may not stand on their own may be prevented from falling down, and the vertical posture of the sandwiches 3*a* and 3*b* may be maintained.

In the present embodiment, in particular, the first movable plate 69 includes the first protrusion 89 and the first recess 91 at the side thereof close to the second movable plate 71, and the second movable plate 71 includes the second recess 93 that accommodates the first protrusion 89 and the second protrusion 95 that is accommodated in the first recess 91, at the side thereof close to the first movable plate 69.

Thus, the contact or collision between the movable plates 69 and 71 when the spacing is reduced may be avoided, and the movable plates 69 and 71 may smoothly move close to and away from each other. Further, in a case where the first movable plate 69 and the second movable plate 71 have the flat surfaces at the sides thereof close to each other, the spacing between the sandwiches 3*a* and 3*b* may not be reduced without a gap unless the sandwiches 3*a* and 3*b* are accurately placed at the ends of the movable plates 69 and 71, respectively, or unless the sandwiches 3*a* and 3*b* are placed to protrude out of the ends of the movable plates 69 and 71, respectively. In the former case, since the positioning accuracy required for the temporary placement is strict, the teaching of the robots 9 and 11 becomes difficult, and in the latter case, the support of the lower surfaces of the sandwiches 3*a* and 3*b* becomes unstable. Thus, in the present embodiment, the first movable plate 69 and the second movable plate 71 have the uneven structure. Thus, even when the sandwich 3*a* is placed on the first movable plate 69 to deviate from the tip of the first protrusion 89, and the sandwich 3*b* is placed on the second movable plate 71 to deviate from the tip of the second protrusion 95, the first protrusion 89 and the second protrusion 95 overlap with each other in the opening/closing direction, so that the spacing between the sandwiches 3*a* and 3*b* may be reduced without a gap. As a result, the positioning accuracy required for the temporary placement may be alleviated, so that the teaching of the robots 9 and 11 becomes easy. Further, the lower surfaces of the placed sandwiches 3*a* and 3*b* may be stably supported by the protrusions 89 and 95 of the movable plates 69 and 71, respectively.

In the present embodiment, in particular, the host controller 19 includes the mode switch 19 that switches the normal mode and the human collaboration mode in which the sandwiches 3 supplied from the previous process by the first conveyance line 33 of the carrier conveyor 7 are packaged in an amount that may be processed by the respective devices of the sandwich packaging system 1 (the first robot 9, the second robot 9, the temporary placement apparatus 13, the third robot 15, and the bag supply device 17) and conveyed by the second conveyance line 35, and when there exist sandwiches 3 that exceed the processing capacity, the remaining sandwiches 3 are conveyed to the subsequent process by the first conveyance line 33, and the through mode in which all of the sandwiches 3 supplied from the previous process by the first conveyance line 33 are conveyed to the subsequent process by the first conveyance line 33.

Accordingly, the normal mode may be performed, for example, when all of the sandwiches 3 supplied from the previous process are packaged by the devices, the human collaboration mode may be performed, for example, when a portion of the sandwiches 3 supplied from the previous process is packaged by the devices and the remaining sandwiches 3 are packaged by the manager M, or the through mode may be performed, for example, when the devices are not operable due to a maintenance or failure, so that the sandwich packaging system 1 may be operated in the optimal aspect according to, for example, the operation status of the production line or the device state of the system.

8. Modifications

The embodiment of the present disclosure is not limited to the descriptions above, and various modifications may be made within the scope that does not depart from the technical gist or idea of the present disclosure.

While the packaging of sandwiches has been described as an example of the layered food, the present disclosure may be applied to the packaging of bread products such as hamburgers, dessert products such as pancakes and cakes, or confectionery products such as cookies and biscuits.

While descriptions have been made on a sandwich having a single-stage structure in which one layer of ingredients is sandwiched between two loaves of bread, the present disclosure may be applied to, for example, a sandwich having a multi-stage structure in which two or more layers of ingredients are sandwiched among three or more loaves of bread. In this case, as in the embodiment described above, the first robot 9 and the second robot 11 may collectively package the two temporarily placed sandwiches simultaneously in parallel, or may alternately temporarily place the sandwiches on the temporary placement apparatus 13, such that the sandwich temporarily placed by the first robot 9 and the sandwich temporarily placed by the second robot 11 may be alternately packaged one by one.

Example of Hardware Configuration of Host Controller

Next, an example of the hardware configuration of the host controller 19 will be described with reference to FIG. 26.

Figure 26:
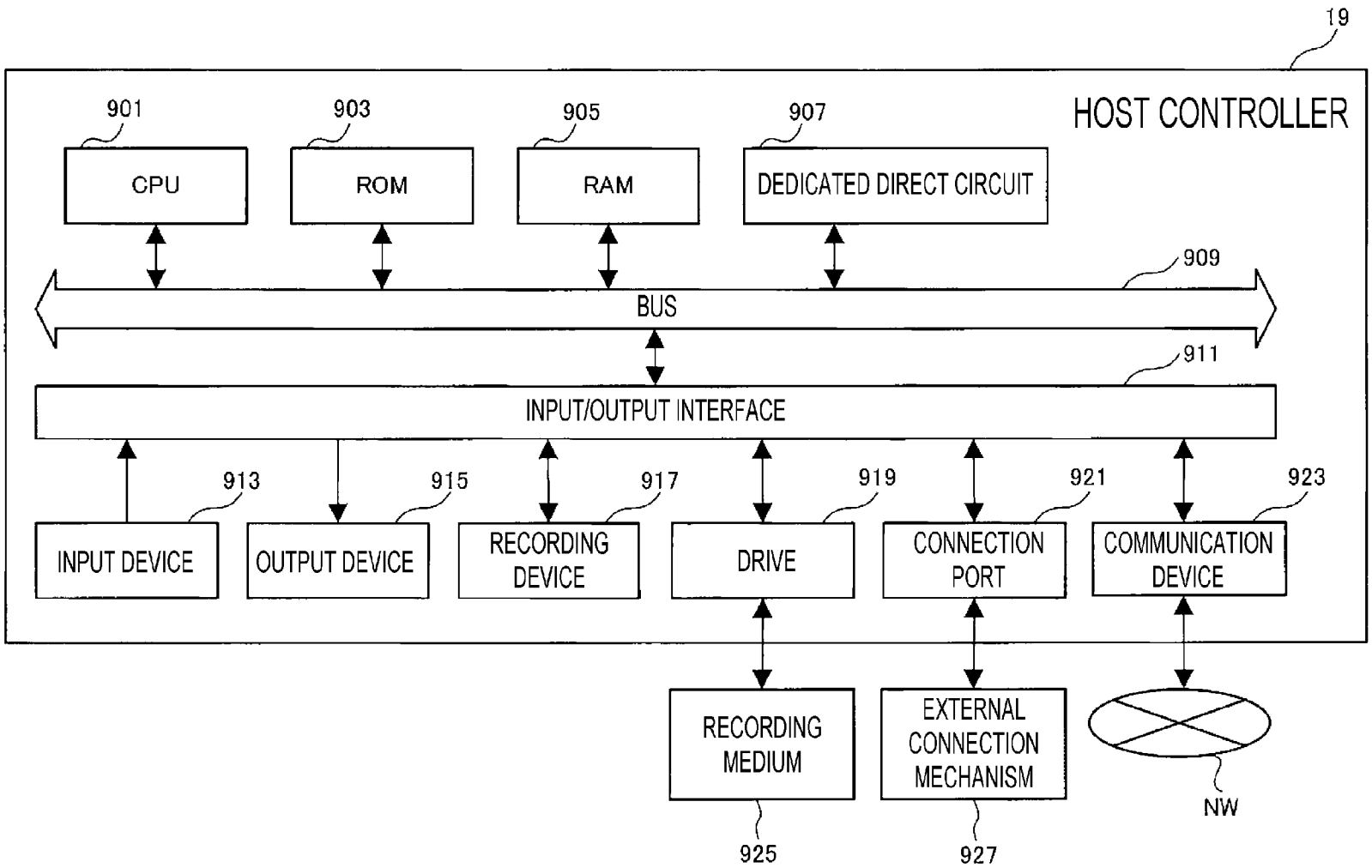
FIG. 26 is a block diagram illustrating an example of a hardware configuration of the host controller.

As illustrated in FIG. 26, the host controller 19 includes, for example, a CPU 901, a ROM 903, a RAM 905, a dedicated integrated circuit 907 constructed for a specific application such as an ASIC or an FPGA, an input device 913, an output device 915, a recording device 917, a drive 919, a connection port 921, and a communication device 923. These components are connected to each other to be able to transmit signals to each other through a bus 909 or an input/output interface 911.

A program may be recorded in, for example, the ROM 903, the RAM 905, or the recording device 917 configured by a hard disk.

Further, a program may be temporarily or non-temporarily (permanently) recorded in, for example, a magnetic disk such as a flexible disk, an optical disk such as various CD•MO disks or DVD, or a removable recording medium 925 such as a semiconductor memory. The recording medium 925 may also be provided as so-called package software. In this case, the program recorded on the recording medium 925 may be read by the drive 919, and recorded in the recording device 917 via, for example, the input/output interface 911 or the bus 909.

Further, a program may be recorded in, for example, a download site, another computer, or another recording device (not illustrated). In this case, the program is transferred via a network NW such as the LAN or the Internet, and the communication device 923 receives the program. Then, the program received by the communication device 923 may be recorded in the recording device 917 via, for example, the input/output interface 911 or the bus 909.

Further, a program may be recorded in, for example, an appropriate external connection device 927. In this case, the program may be transferred via an appropriate connection port 921, and recorded in the recording device 917 via, for example, the input/output interface 911 or the bus 909.

Then, when the CPU 901 executes various processes according to the program recorded in the recording device 917, the processes by the corrector 115, the determination unit 117, the mode switch 119 and others are implemented. At this time, for example, the CPU 901 may directly read the program from the recording device 917 and execute the program, or may execute the program after loading the program into the RAM 905 once. Further, for example, when the CPU 901 receives the program via the communication device 923, the drive 919, or the connection port 921, the CPU 901 may directly execute the received program without recording the program in the recording device 917.

Further, for example, the CPU 901 may execute the various processes based on signals or information input from the input device 913 such as a mouse, a keyboard, or a microphone (not illustrated) as needed.

Then, the CPU 901 may output the result of the execution of the processes described above from the output device 915 such as a display device or an audio output device, may transmit the process result via the communication device 923 or the connection port 921 as needed, or may cause the process result to be recorded in the recording device 917 or the recording medium 925.

In the descriptions above, for example, the terms "vertical," "parallel," and "plane" do not have strict meanings. That is, the terms "vertical," "parallel," and "plane" allow tolerances and errors in design and manufacturing, and mean "substantially vertical," "substantially parallel," and "substantially plane."

In the descriptions above, for example, the terms "similar," "same," "equal," and "different" in an external dimension or size, a shape, a position or the like do not have strict meanings. That is, the terms "similar," "same," "equal," and "different" allow tolerances and errors in design and manufacturing, and mean "substantially similar," "substantially the same," "substantially equal," "substantially different."

According to the layered food packaging system or the like of the present disclosure, the quality of the packaging may be improved.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A layered food packaging system comprising:

a carrier device configured to convey a layered food in a first posture in which a layering direction of the layered food is substantially vertical;

a temporary placement table configured to temporarily place the layered food thereon in a second posture in which the layering direction is substantially horizontal;

a first gripper configured to grip the layered food that is conveyed by the carrier device, lift the layered food from the carrier device, change the posture of the layered food from the first posture to the second posture, and temporarily place the layered food on the temporary placement table;

a second gripper configured to grip the layered food that is temporarily placed on the temporary placement table, and insert the layered food into a bag for packaging the layered food, a camera configured to capture an image of the plurality of pieces of the layered food that have been spacing-reduced by the spacing reducer; and a host controller configured to determine whether to perform a packaging for the plurality of pieces of the layered food, based on a result of the image capturing by the camera, wherein the temporary placement table includes a spacing reducer including a pair of clamping plates, the spacing reducer being configured to reduce a spacing between a plurality of pieces of the layered food that is temporarily placed in the temporary placement table in the second posture, in the layering direction, wherein the second gripper grips the plurality of pieces of the layered food that have been spacing-reduced, and inserts the plurality of pieces of the layered food into the bag, and wherein when the host controller determines to perform the packaging, the second gripper grips the plurality of pieces of the layered food that have been spacing-reduced, and inserts the plurality of pieces of the layered food into the bag.

2. The layered food packaging system according to claim 1, wherein the carrier device includes a first conveyance line configured to convey the layered food that is supplied from a previous process before the layered food packaging system toward a gripping position where a gripping is performed by the first gripper, and convey the layered food that is not gripped by the first gripper toward a subsequent process after the layered food packaging system while passing through the gripping position, and a second conveyance line disposed adjacent to the first conveyance line, and configured to convey the layered food that is gripped by the first gripper at the gripping position of the first conveyance line, temporarily placed on the temporary placement table, and inserted/packaged into the bag by the second gripper.

3. The layered food packaging system according to claim 1, wherein the first gripper includes a pair of first tong members configured to grip the layered food, and the second gripper includes a pair of second tong members configured to grip the layered food that is temporarily placed on the temporary placement table, wherein a dimension of the first tong members is smaller than that of the second tong members.

4. The layered food packaging system according to claim 1, wherein the carrier device includes:

a first conveyance line configured to convey the layered food that is supplied from a previous process before the layered food packaging system toward a gripping position where a gripping is performed by the first gripper, and convey the layered food that is not gripped by the first gripper toward a subsequent process after the layered food packaging system while passing through the gripping position, and a second conveyance line disposed adjacent to the first conveyance line, and configured to convey the layered food that is gripped by the first gripper at the gripping position of the first conveyance line, temporarily placed on the temporary placement table, and inserted/packaged into the bag by the second gripper, and the layered food packaging system further comprises:

a mode switch provided in the host controller and configured to perform a switching between a first mode in which the layered food that is supplied from the previous process by the first conveyance line is packaged in an amount processible in the first gripper, the temporary placement table, and the second gripper, and conveyed by the second conveyance line, and remaining layered food that exceeds a processing capacity is conveyed to the subsequent process by the first conveyance line, and a second mode in which all of the layered food that are supplied from the previous process by the first conveyance line are conveyed to the subsequent process by the first conveyance line.

* * * * *